US007307821B2

(12) United States Patent
Wang

(10) Patent No.: US 7,307,821 B2
(45) Date of Patent: Dec. 11, 2007

(54) GROUND FAULT CIRCUIT INTERRUPTER WITH REVERSE WIRING AND END-OF-LIFE PROTECTION

(75) Inventor: Ping Wang, Chuzhou (CN)

(73) Assignee: Wenzhou Sansheng Electrical Co., Ltd., Zhejiang (CN)

( * ) Notice: Subject to any disclaimer, the term of this patent is extended or adjusted under 35 U.S.C. 154(b) by 0 days.

(21) Appl. No.: 11/542,515

(22) Filed: Oct. 2, 2006

(65) Prior Publication Data

US 2007/0132530 A1 Jun. 14, 2007

Related U.S. Application Data

(63) Continuation-in-part of application No. 11/449,991, filed on Jun. 9, 2006, and a continuation-in-part of application No. 11/072,855, filed on Mar. 3, 2005, now Pat. No. 7,116,191, and a continuation-in-part of application No. 10/945,672, filed on Sep. 21, 2004, now Pat. No. 7,167,066.

(51) Int. Cl.
*H01F 73/00* (2006.01)

(52) U.S. Cl. ..... 361/42; 335/18

(58) Field of Classification Search ..... 335/18; 361/42

See application file for complete search history.

(56) References Cited

U.S. PATENT DOCUMENTS 4,802,052 A 1/1989 Brant et al.
5,363,269 A 11/1994 McDonald
5,541,800 A 7/1996 Misencik
6,040,967 A 3/2000 DiSalvo
6,111,733 A 8/2000 Neiger et al.
6,226,161 B1 5/2001 Neiger et al.
6,246,558 B1 6/2001 DiSalvo et al.
6,282,070 B1 8/2001 Ziegler et al.
6,381,112 B1 4/2002 DiSalvo
6,437,953 B2 8/2002 DiSalvo et al.
6,580,344 B2 6/2003 Li
6,611,406 B2 8/2003 Neiger et al.
6,628,486 B1 9/2003 Macbeth
6,646,838 B2 11/2003 Ziegler et al.
6,657,834 B2 12/2003 DiSalvo
6,697,238 B2 2/2004 Bonilla et al.

(Continued)

*Primary Examiner*—Ramon M. Barrera
(74) *Attorney, Agent, or Firm*—Hogan & Hartson LLP

(57) ABSTRACT

A circuit interrupter comprises a pair of fixed contact strips, a pair of load contact strips, a pair of movable contact strips, a reset component, a movable component, and a trip component that contains a reset contact. Each of the fixed contact strips has a fixed contact. Each of the load contact strips has a load contact. Each of the movable contact strips has a fixed end and a movable end. The movable end of each movable contact strip is split into an inner sub-strip and an outer sub-strip. Each movable end has a first movable contact disposed on the inner sub-strip arranged for contacting one of the corresponding load contacts and a second movable contact disposed on the outer sub-strip arranged for contacting one of the corresponding fixed contacts. The movable component, disposed to sustain the movable ends of the movable contact strips, allow the inner sub-strips and the outer sub-strips to rest on different horizontal planes. The movable component is capable of either being latched with or released from the reset component to move between a first position, a second position, and a third position.

43 Claims, 17 Drawing Sheets

U.S. PATENT DOCUMENTS

| | | | | |
|---|---|---|---|---|
| 6,734,769 | B1 | 5/2004 | Germain et al. | |
| 6,937,452 | B2 | 8/2005 | Chan et al. | |
| 7,049,911 | B2 * | 5/2006 | Germain et al. | 335/18 |
| 2003/0086220 | A1 | 5/2003 | Nelson | |
| 2004/0070474 | A1 | 4/2004 | Wu et al. | |
| 2004/0070897 | A1 | 4/2004 | Wu et al. | |
| 2004/0080879 | A1 | 4/2004 | Radosavljevic et al. | |
| 2004/0264077 | A1 | 12/2004 | Radosavljevic et al. | |
| 2005/0286183 | A1 * | 12/2005 | Germain | 361/42 |
| 2006/0018059 | A1 | 1/2006 | Elms et al. | |

* cited by examiner

GROUND FAULT CIRCUIT INTERRUPTER WITH REVERSE WIRING AND END-OF-LIFE PROTECTION

This is a continuation-in-part of patent application Ser. No. 10/945,672, filed on Sep. 21, 2004, now U.S. Pat. No. 7,167,066, patent application Ser. No. 11/072,855, filed on Mar. 3, 2005, now U.S. Pat. No. 7,116,191, and patent application Ser. No. 11/449,991, filed on Jun. 9, 2006.

BACKGROUND

1. Field of the Invention

The present invention relates to a ground fault circuit interrupter (GFCI) device for protecting an alternating current load circuit, and more particularly to a GFCI with reverse wiring and end-of-life protection.

2. Description of the Related Art

With the increasing use of household electrical appliances, people demand that receptacles installed in their houses be capable of protecting them from serious injury when accidentally touched or other ground fault conditions occur. Thus, ground fault circuit interrupters are designed to break the electrical continuity upon detecting a ground fault condition occurring at an alternating current (AC) load.

Many electrical wiring devices including receptacles have a line side that is connectable to an electrical power supply, and a load side that is connectable to one or more loads and at least one conductive path between the line side and load side. When a person accidentally comes in contact with the line side of the AC load and an earth ground at the same time, a serious injury may occur because the human body forms another conductive path for the electrical current to flow through. There is a strong desire for electrical wiring devices that can break electric power supply to various loads such as household appliances and consumer electronic products.

The GFCI devices can detect a ground fault condition and break the electric power supply by employing a sensing transformer to detect an imbalance between the currents flowing in the phase (also known as "hot") and neutral conductive paths of the power supply. A ground fault condition happens when the current is diverted to the ground through another path such as a human body, that results in an imbalance between the currents flowing in the phase and neutral conductors. Upon detection of a ground fault condition, a breaker within the GFCI devices is immediately tripped to interrupt the electrical continuity and removes all power supply to the loads.

Some circuit interrupters, such as GFCI receptacles, have a user accessible load in addition to the line side and load side connections. Users can connect other household appliances to the power supply through plug entries on the receptacle. However, due to the similarity of line side and load side terminals, instances may occur where the line wires are connected to the load side connection and the load wires are connected to the line side connection. This is known as reverse wiring. When reverse wiring occurs, the GFCI devices usually do not provide ground fault protection to the user accessible load. It is a problem if there is no warning provided to an installer when the GFCI devices have reverse wiring. Thus, it is desired to design a GFCI device which can disable the reset function when the GFCI device has reverse wiring. Moreover, it is strongly desired that a GFCI does not even provide electricity to user accessible loads to better protect consumers when there is reverse wiring.

In addition, because of the high stability requirement of the GFCI devices' quality, it is also desired for GFCI devices to have a simpler design, less components so that they are easier to be assembled, installed, and correctly wired.

SUMMARY OF THE PREFERRED EMBODIMENTS

One embodiment of the invented circuit interrupter comprises a pair of fixed contact strips, a pair of load contact strips, a pair of movable contact strips, a reset component, a movable component, and a trip component that contains a reset contact. Each of the fixed contact strips has a fixed contact. Each of the load contact strips has a load contact. Each of the movable contact strips has a fixed end and a movable end. The movable end of each movable contact strip is split into an inner sub-strip and an outer sub-strip. Each movable end has a first movable contact disposed on the inner sub-strip arranged for contacting one of the corresponding load contacts and a second movable contact disposed on the outer sub-strip arranged for contacting one of the corresponding fixed contacts.

The movable component, disposed to sustain the movable ends of the movable contact strips, allow the inner sub-strips and the outer sub-strips to rest on different horizontal planes. The movable component is capable of either being latched with or released from the reset component to move between a first position where the first movable contacts are separated from the load contacts, and the second movable contacts are separated from the fixed contacts, and the movable contact strips are not electrically coupled to the reset contact, a second position where the first movable contacts are separated from the load contacts, and the second movable contacts are separated from the fixed contacts, and at least one of the movable contact strips is electrically coupled to the reset contact, and a third position where the first movable contacts make contact with the corresponding load contacts, and the second movable contacts make contact with the corresponding fixed contacts, and the movable contact strips are not electrically coupled to the reset contact.

The trip component is capable of latching the reset component with the movable component for the movable component to move to the third position upon detection of a reset request and releasing the reset component from the movable component for movable component to move to the first position upon detection of a fault condition.

BRIEF DESCRIPTION OF THE DRAWINGS

A more complete understanding of the present invention can be obtained by reference to the detailed description of embodiments in conjunction with the accompanying drawings. These drawings depict only a typical embodiment of the invention and do not therefore limit its scope. They serve to add specificity and details, in which.

DETAILED DESCRIPTION

Figure 1:
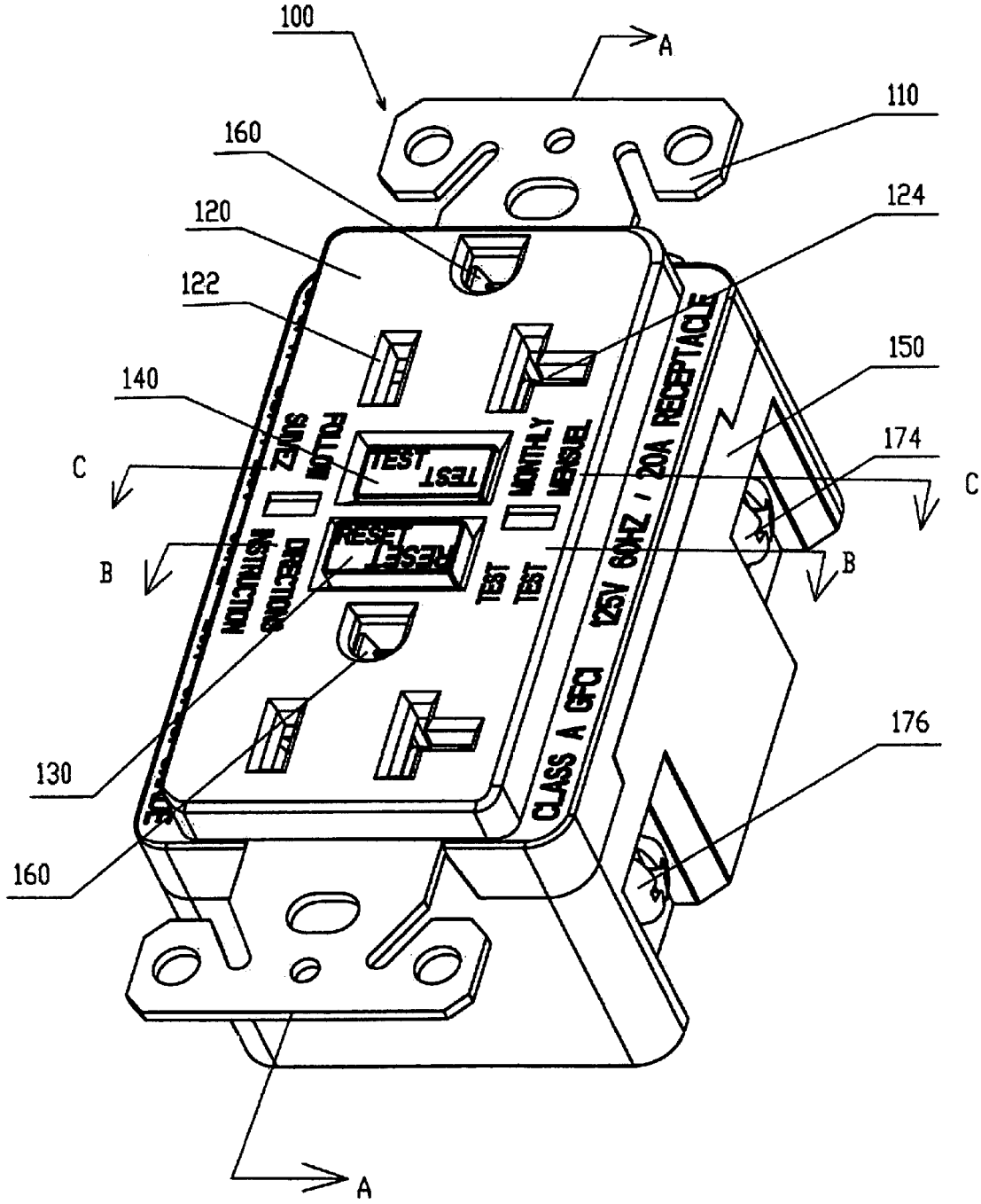
FIG. 1 is a perspective view of an exemplary embodiment of a circuit interrupter.
Figure 2:
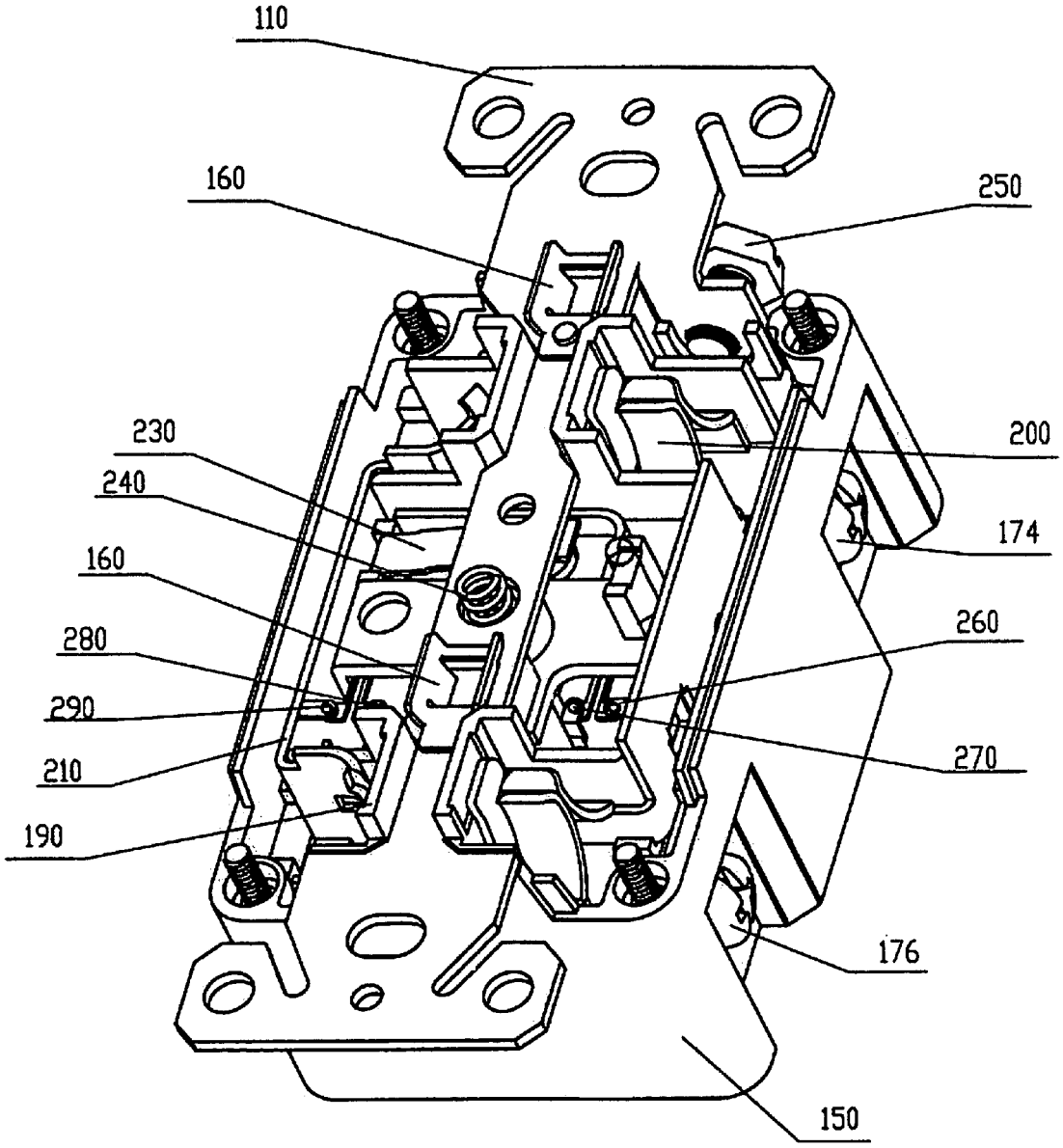
FIG. 2 is a perspective view of the circuit interrupter in FIG. 1 with a face portion removed, illustrating the internal configuration.

As shown in FIG. 1, an exemplary embodiment 100 of a circuit interrupter has a housing which comprises a face portion 120, a middle body 190 (shown in FIG. 2), and a rear portion 150. The face portion 120 has entry ports 122, 124 for receiving normal or polarized prongs of a male plug, as well as ground-prong-receiving openings 160 to accommodate a three-wire plug. The circuit interrupter 100 contains a mounting strap 110 used to fasten the receptacle to a junction box. As shown in FIG. 2, the mounting strap 110 has a threaded opening to receive a ground screw 250 for connecting to an external ground wire.

A reset button 130 extends through an opening in the face portion 120 of the housing. The reset button 130 is used to activate a reset operation which re-establishes the electrical continuity in open conductive paths. A test button 140 extends through an opening in the face portion 120 of the housing. The test button 140 is used to break the electrical continuity in close conductive paths by simulating a fault condition.

Figure 15:
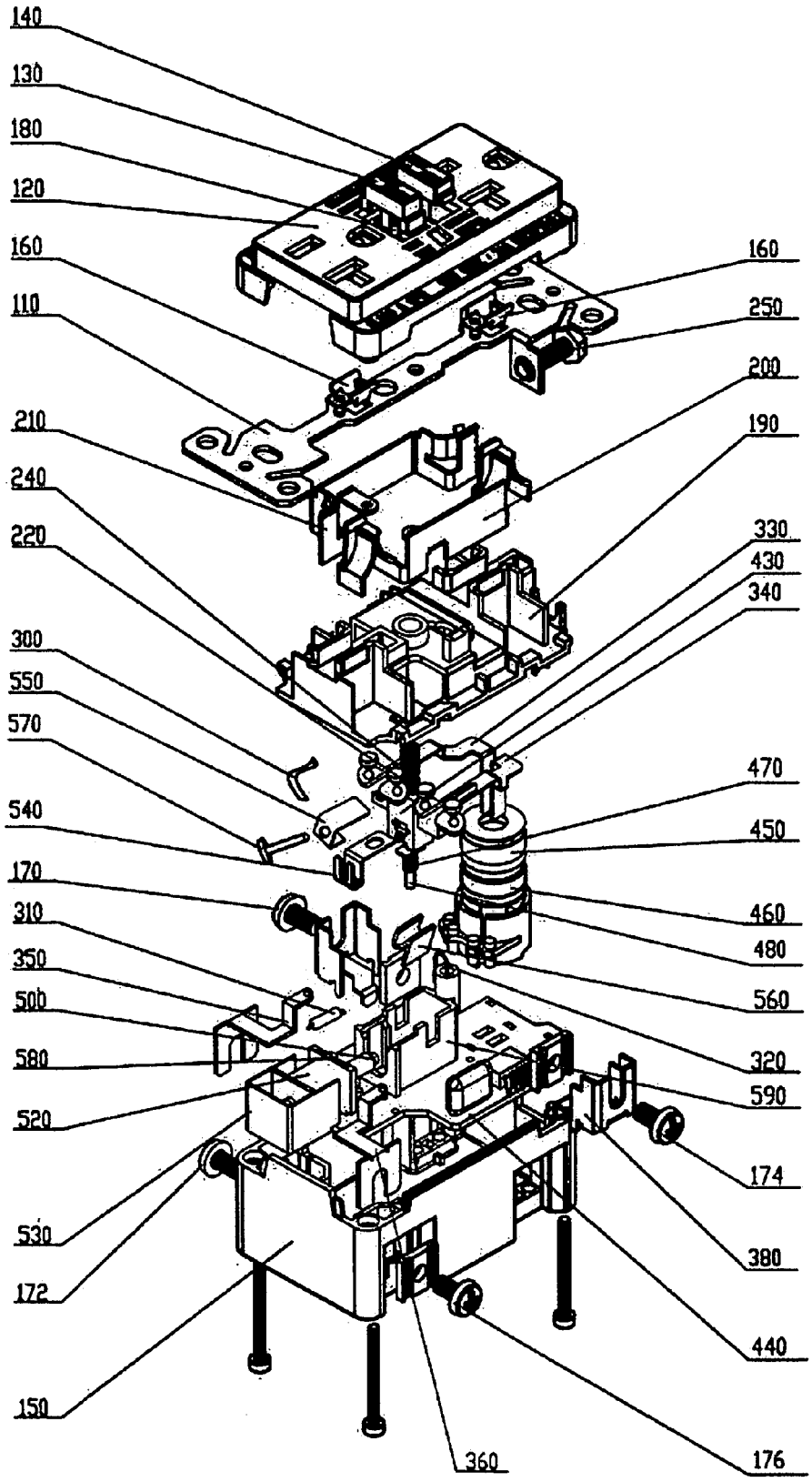
FIG. 15 is an exploded view of the circuit interrupter in FIG. 1.

As shown in FIGS. 1 and 15, electricity connects to the circuit interrupter 100 through binding screws 170, 172, 174, and 176 where the binding screw 170 is a line phase connection, the binding screw 174 is a line neutral connection, the binding screw 172 is a load phase connection, and the binding screw 176 is a load neutral connection. In addition to binding screws, people in the art will appreciate other types of wiring terminals such as set screws, pressure clamps, pressure plates, push-in type connections, pigtails, and quick-connect tabs.

Figure 3:
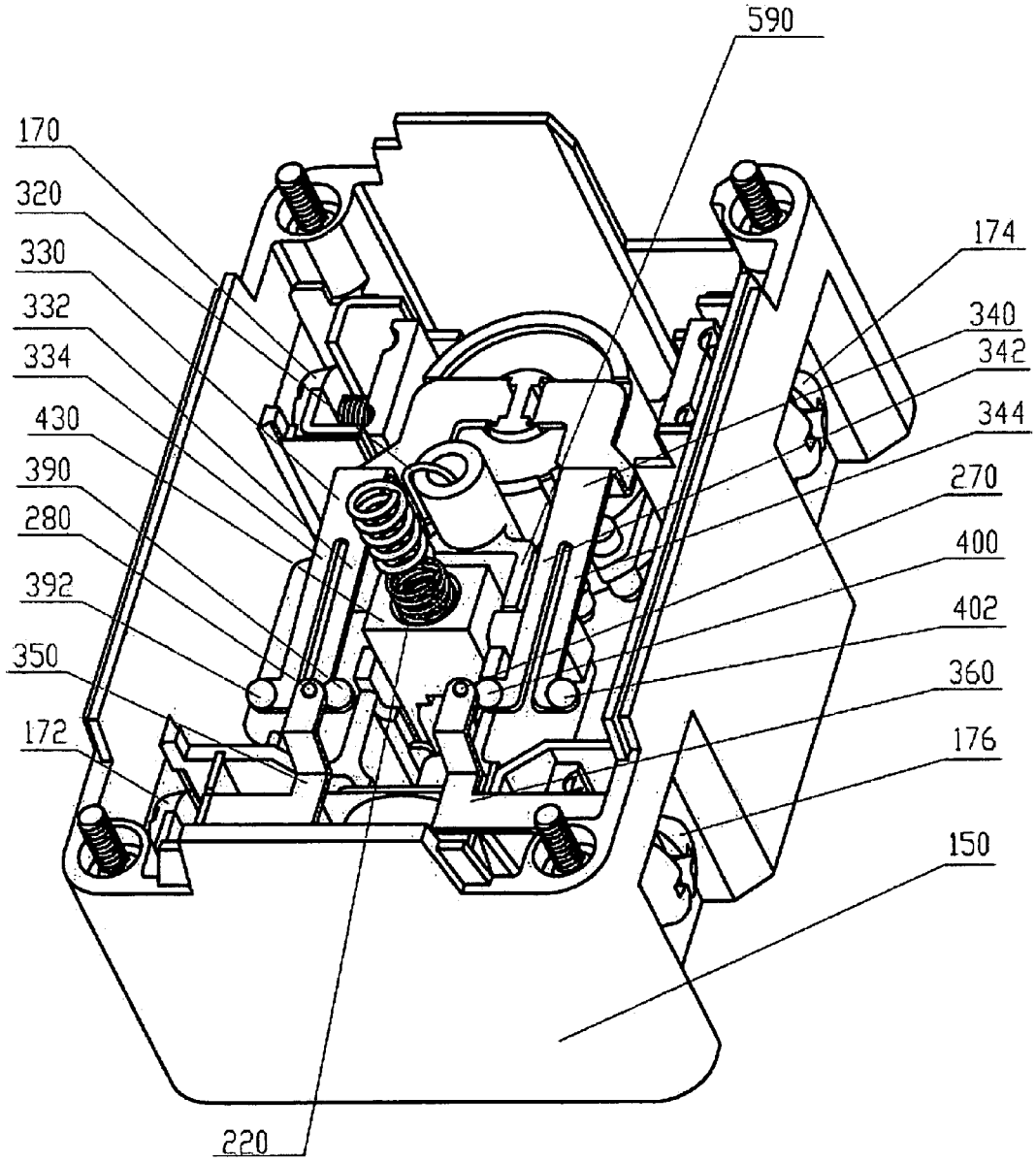
FIG. 3 is a perspective view of the circuit interrupter in FIG. 2 with a mounting strap and a middle body removed, further illustrating the internal configuration.
Figure 4:
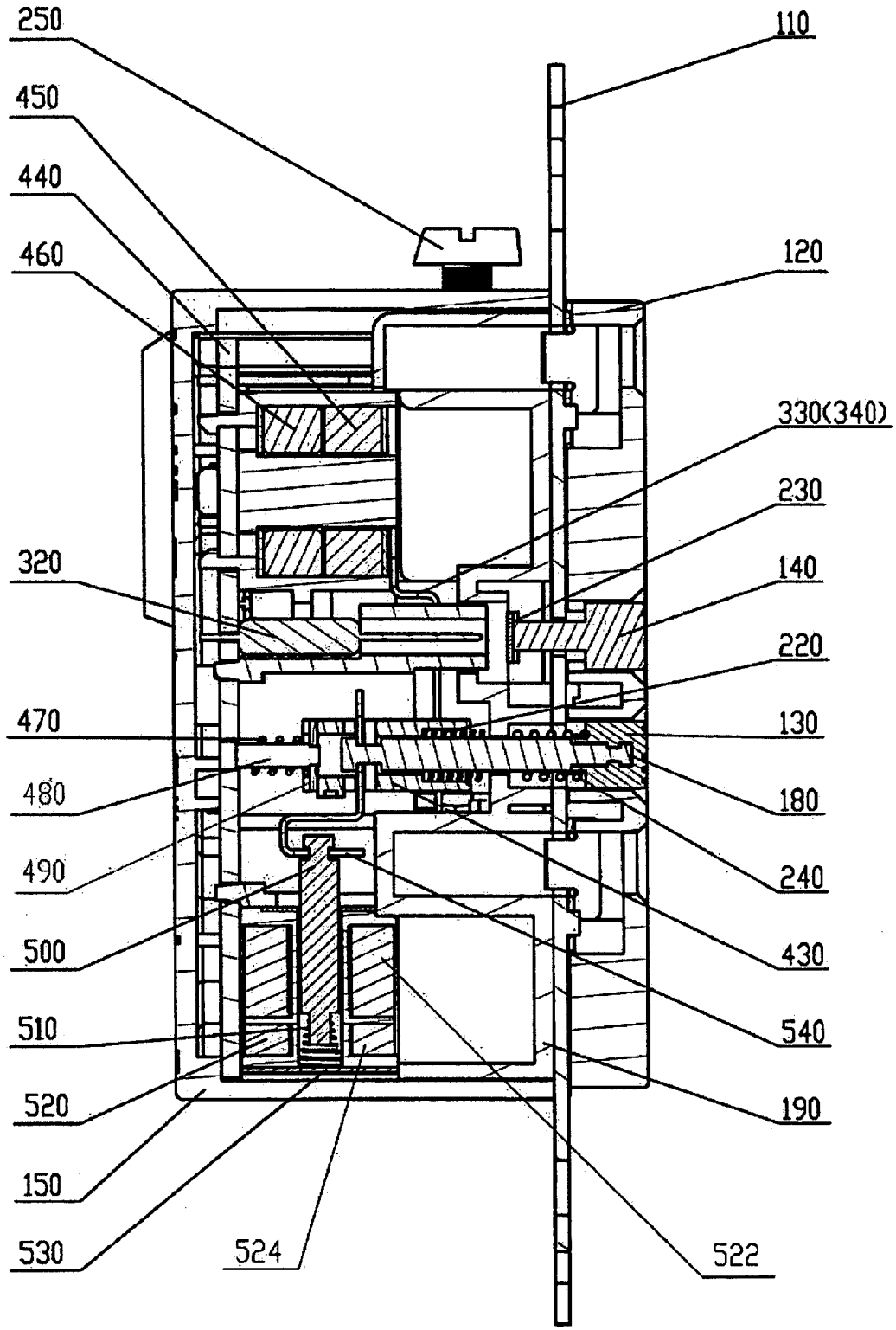
FIG. 4 illustrates a cross-sectional view of the circuit interrupter in FIG. 1 along the AA line in a reset condition.
Figure 6A:
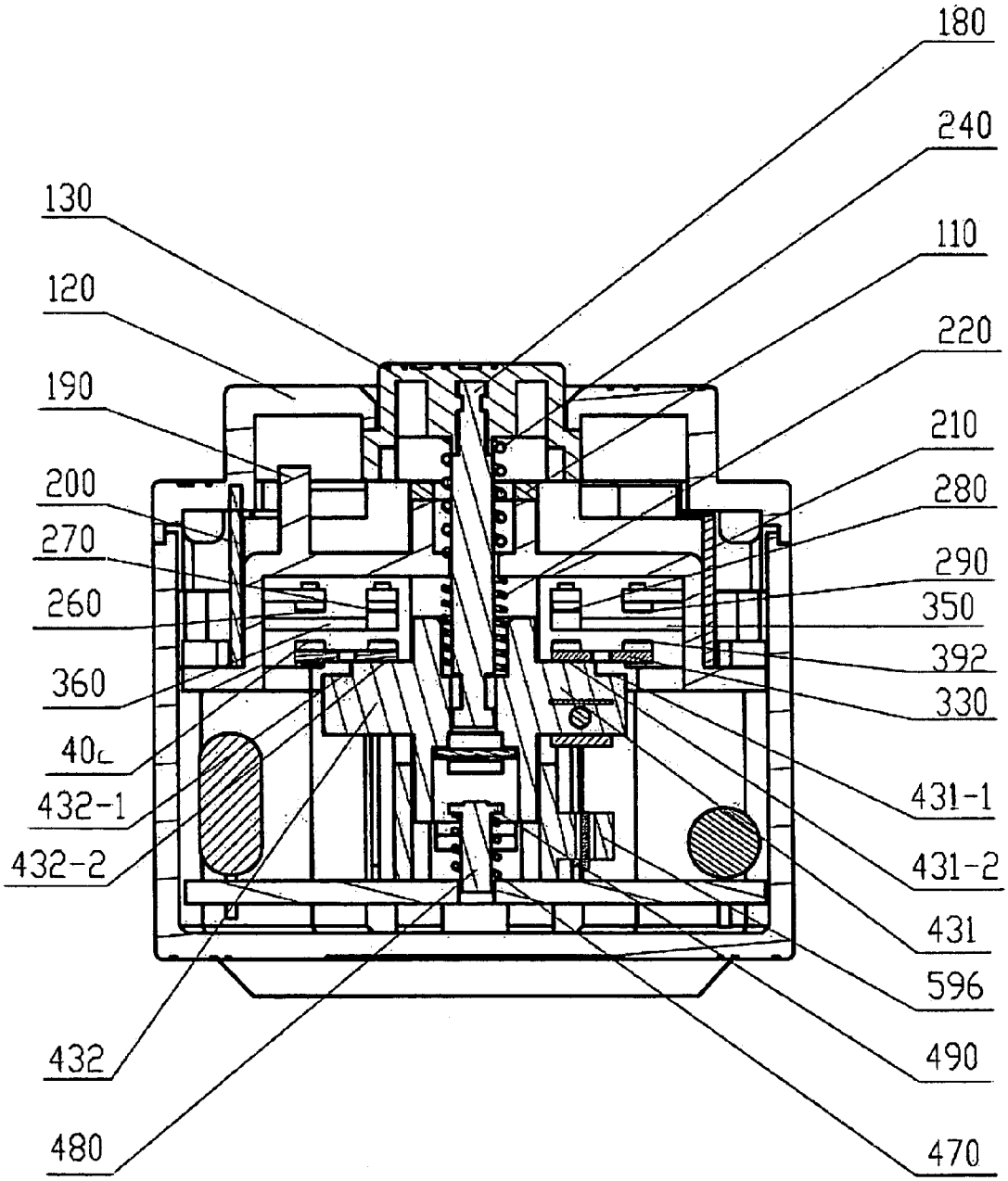
FIG. 6A illustrates a cross-sectional view of the circuit interrupter in FIG. 1 along the BB line in a trip condition.
Figure 6B:
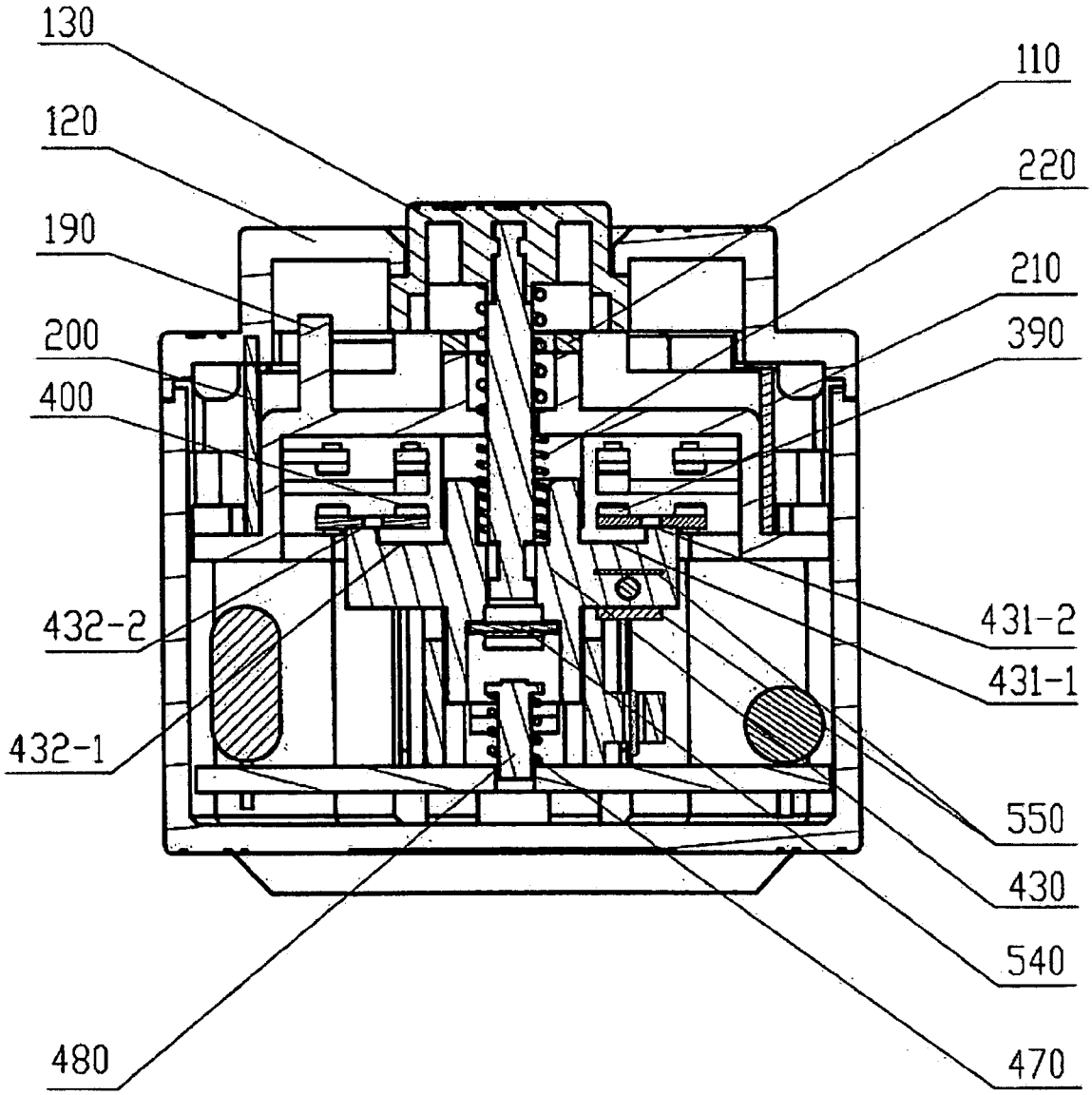
FIG. 6B illustrates a cross-sectional view of the circuit interrupter in FIG. 1 along the BB line in a trip condition with different embodiment of the sustaining portions of the movable assembly.
Figure 7:
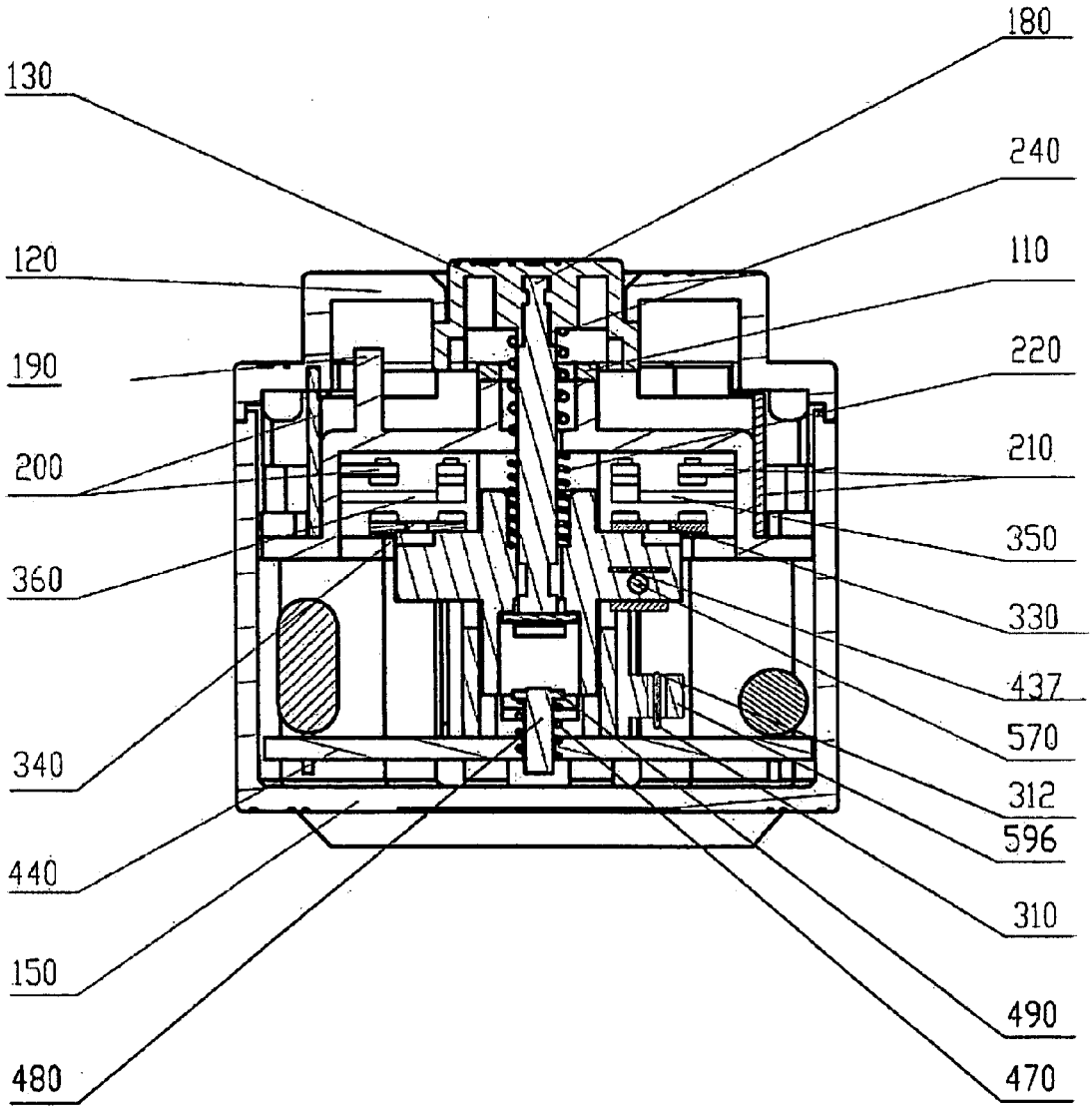
FIG. 7 illustrates a cross-sectional view of the circuit interrupter in FIG. 1 along the BB line in a transient condition when a reset button is pressed.
Figure 8:
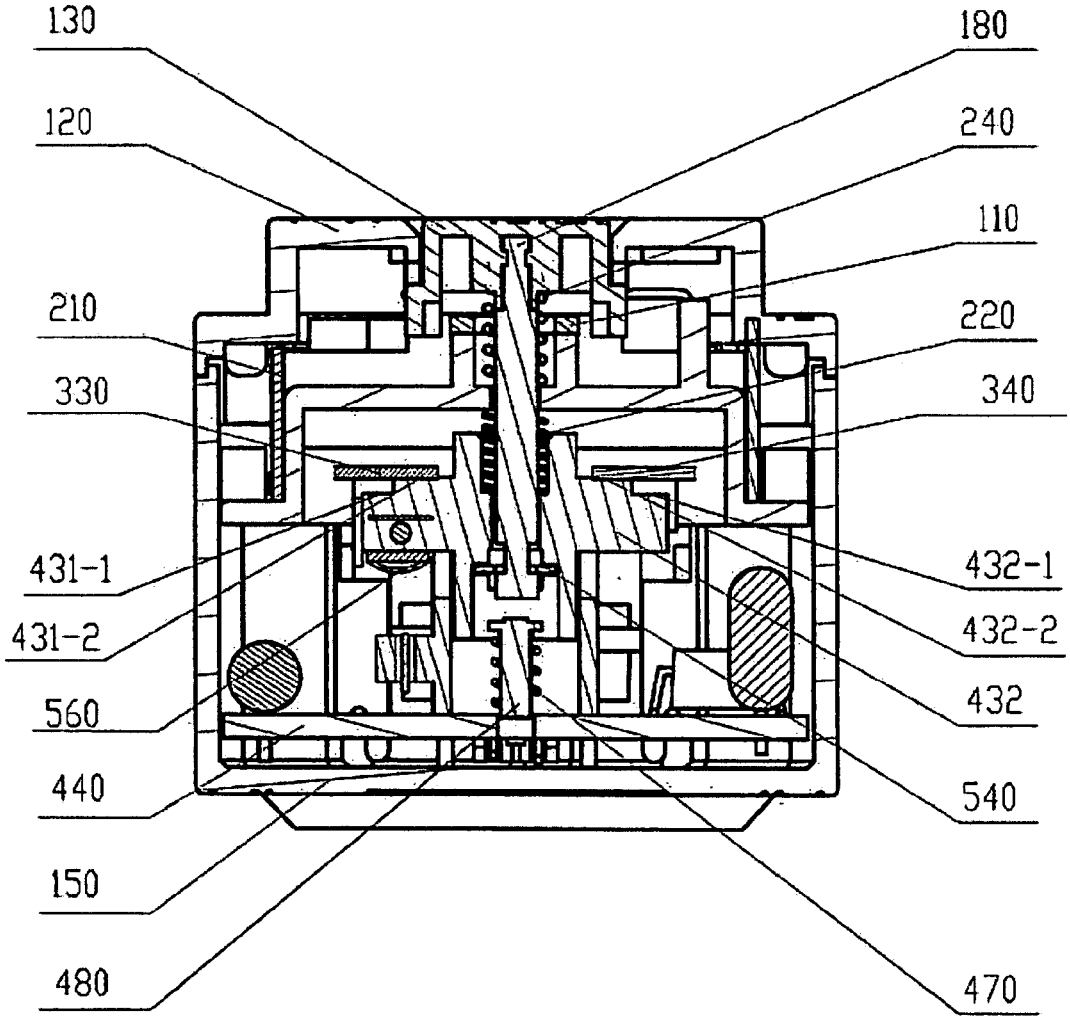
FIG. 8 illustrates a cross-sectional view of the circuit interrupter in FIG. 1 along the opposite direction of BB line in a reset condition.
Figure 9:
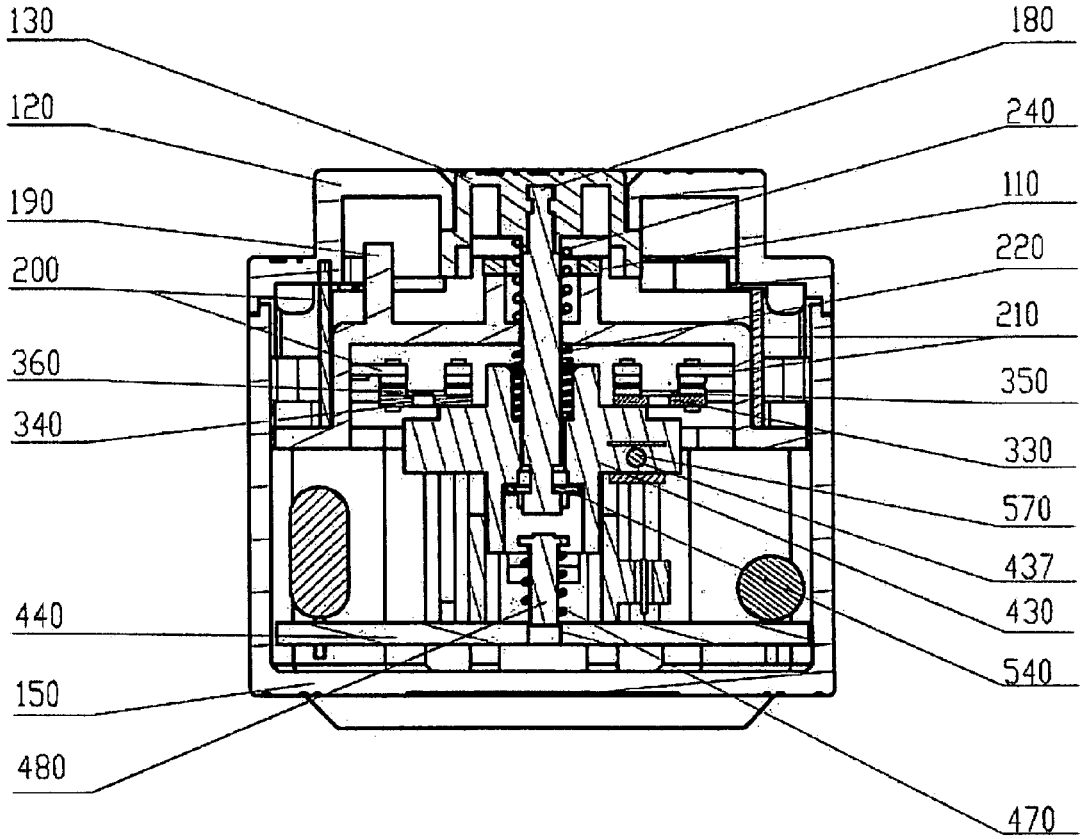
FIG. 9 illustrates a cross-sectional view of the circuit interrupter in FIG. 1 along the BB line in a reset condition.
Figure 10:
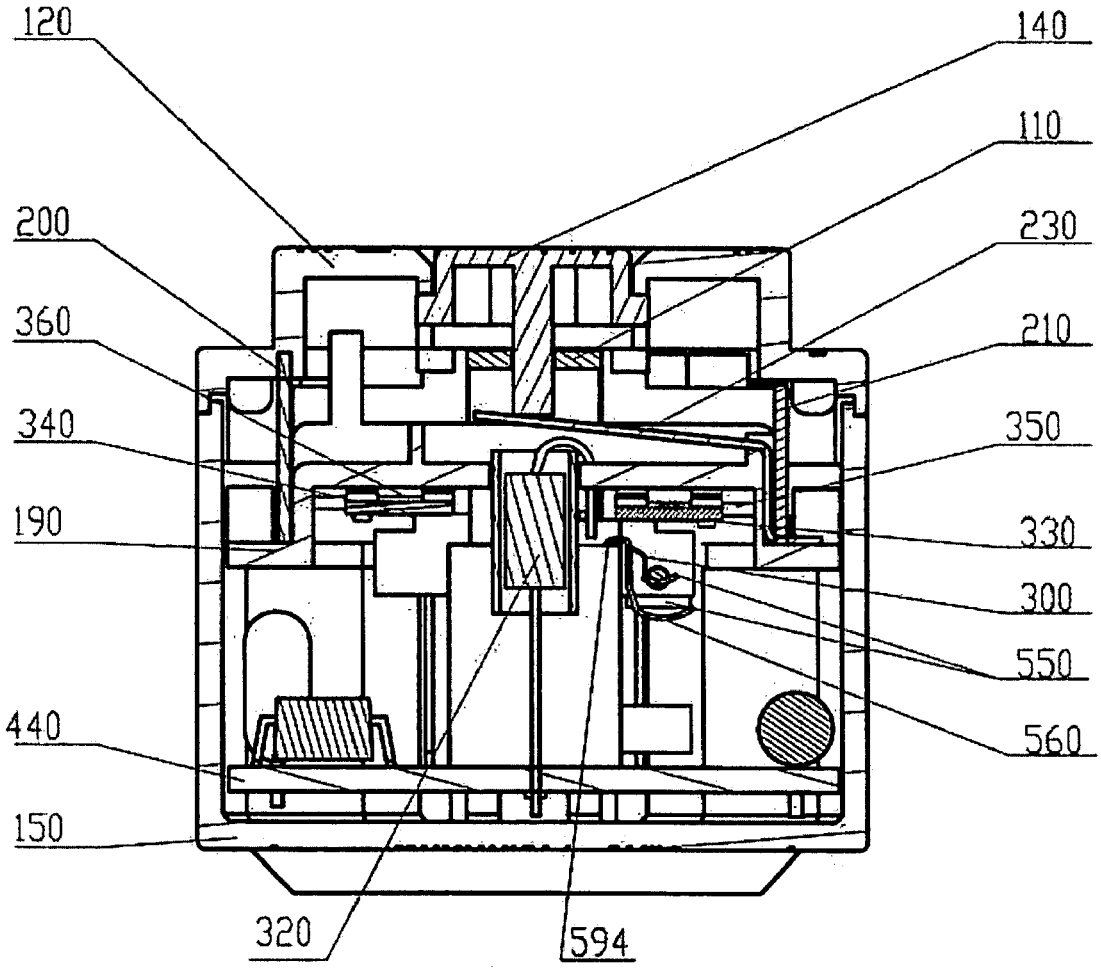
FIG. 10 illustrates a cross-sectional view of the circuit interrupter in FIG. 1 along the CC line with a test component.
Figure 11:
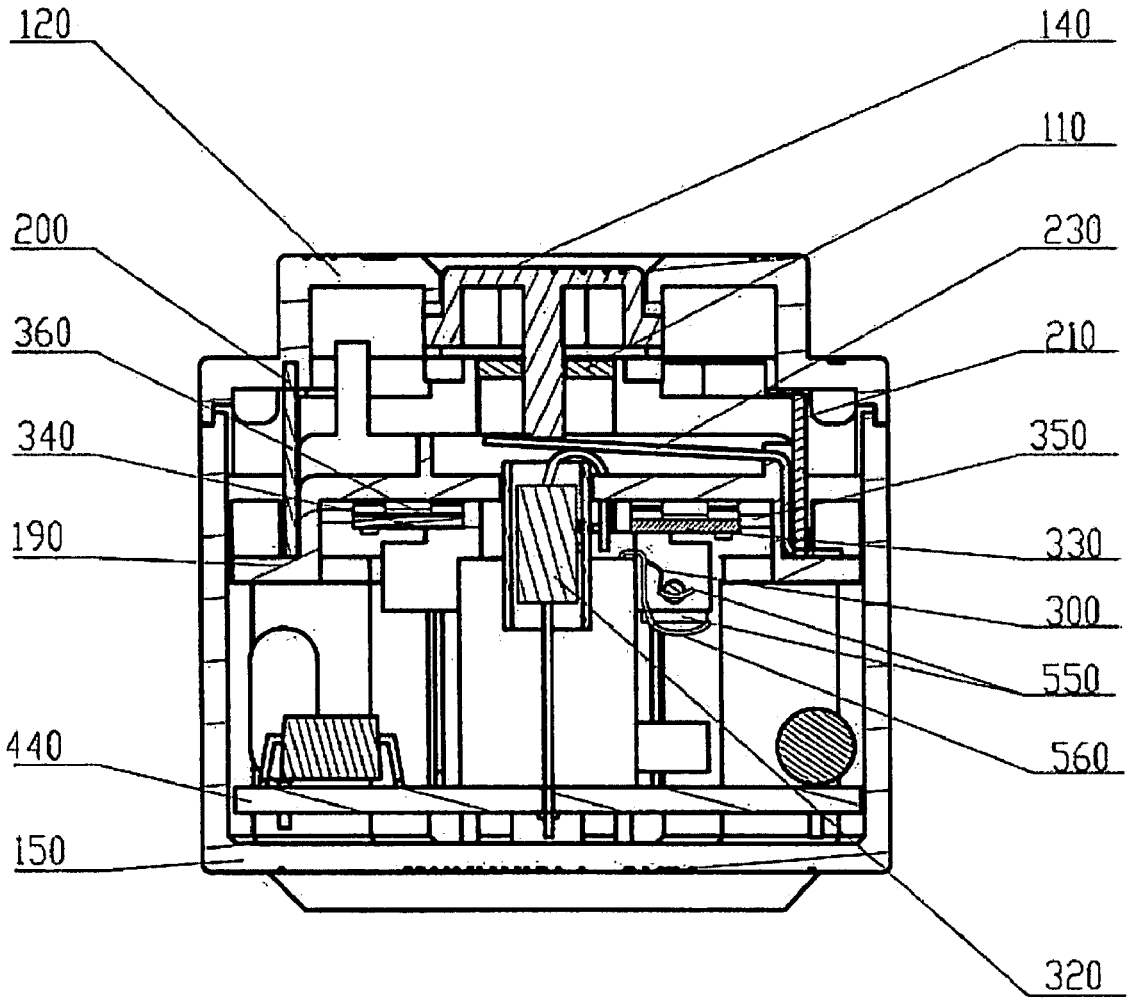
FIG. 11 illustrates a cross-sectional view of the circuit interrupter in FIG. 1 along the CC line in a transient condition when a test button is pressed.

As shown in FIGS. 2, 3, and 6, the conductive path between the line neutral connection 174 and the load neutral connection 176 comprises a right movable contact strip 340 with one end electrically coupled to the line neutral connection 174 and the other end movable to establish and break the electrical continuity, a first right movable contact 400 mounted onto the right inner sub-strip 342 of the right movable contact strip 340, a right load contact strip 360 electrically coupled to the load neutral connection 176, and a right load contact 270 mounted onto the right load contact strip 360. A user accessible load neutral connection contains binding terminals capable of engaging a prong of a male plug inserted therebetween. The conductive path between the line neutral connection 174 and the user accessible load neutral connection comprises a right movable contact strip 340 with one end electrically coupled to the line neutral connection 174 and the other end movable to establish and break the electrical continuity, a second right movable contact 402 mounted onto the right outer sub-strip 344 of the right movable contact strip 340, a right fixed contact strip 200 electrically coupled to the binding terminals, and a right fixed contact 260 mounted onto the right fixed contact strip 200.

Similarly, the conductive path between the line phase connection 170 and the load phase connection 172 comprises a left movable contact strip 330 with one end electrically coupled to the line phase connection 170 and the other end movable to establish and break the electrical continuity, a first left movable contact 390 mounted onto the left inner sub-strip 332 of the left movable contact strip 330, a left load contact strip 350 electrically coupled to the load phase connection 172, and a left load contact 280 mounted onto the left load contact strip 350. A user accessible load phase connection contains binding terminals capable of engaging a prong of a male plug inserted therebetween. The conductive path between the line phase connection 170 and the user accessible load phase connection comprises a left movable contact strip 330 with one end electrically coupled to the line phase connection 170 and the other end movable to establish and break the electrical continuity, a second left movable contact 392 mounted onto the left outer sub-strip 334 of the left movable contact strip 330, a left fixed contact strip 210 electrically coupled to the binding terminals, and a left fixed contact 290 mounted onto the left fixed contact strip 210.

As shown in FIGS. 1-14, the circuit interrupter 100 contains the movable contact strips 330, 340, the fixed contact strips 200, 210, the load contact strips 350, 360, a reset component, a test component, a movable component, and a trip component with a reset contact 312. The movable end of left movable contact strip 330 is split into a left inner sub-strip 332 and a left outer sub-strip 334 from an appropriate place with the first left movable contact 390 located on the left inner sub-strip 332 and second left movable contact 392 located on the left outer sub-strip 334. The movable end of right movable contact strip 340 is split into a right inner sub-strip 342 and a right outer sub-strip 344 from an appropriate place with the first right movable contact 400 located on the right inner sub-strip 342 and second right movable contact 402 located on the right outer sub-strip 344. People in the art understand that the shape of the movable contacts strips 330, 340, the load contact strips 350, 360, and the fixed contact strips 200, 210, and the location of these contact strips may vary as long as four contact pairs, the first left movable contact 390 corresponding to the left load contact 280, the second left movable contact 392 corresponding to the left fixed contact 290, the first right movable contact 400 corresponding to the right load contact 270, and the second right movable contact 402 corresponding to the right fixed contact 260 maintain a good contact in a reset condition.

A protruding contact 550 (shown in FIG. 14) is electrically coupled to the left movable contact strip 330 for the reset operation. When the reset button 130 of the reset component is pressed, the reset component moves down and causes the left movable contact strip 330 to electrically connect to the reset contact 312 through the protruding contact 550. The trip component is then activated to latch the reset component with the movable component. When the reset button 130 is released, the reset component moves up and brings the movable component up together. The left movable contact strip 330 does not electrically connect to the reset contact 312. The movable component further pushes the movable ends of the movable contact strips 330, 340 up to a position where first movable contacts 390, 400 maintain a good contact with corresponding load contacts 280, 270 and where second movable contacts 392, 402 maintain a good contact with corresponding fixed contacts 290, 260. Accordingly, the reset operation re-establishes the electrical continuity between the line end and the load end as well as between the line end and the user accessible load end. When the test button 140 is pressed, the test component activates the trip component to release the reset component from the movable component. The movable component moves down and causes the movable contacts 390, 392, 400, 402 to separate from the fixed contacts 260, 290 and the load contacts 270, 280. Accordingly, the test operation simulates a fault condition to break the electrical continuity.

The reset component comprises the reset button 130, a reset shaft 180, and a reset spring 240. One end of the reset shaft 180 is molded into the underside of reset button 130 and the other end extends through the middle body 190 into the movable component. The reset spring 240 surrounds an upper portion of the reset shaft 180 and is partially disposed in a cup-shape portion of the middle body 190. Thus, one end of the reset spring 240 props up the reset button 130 and the other end presses onto an upper surface of the middle body 190. In other words, the reset spring 240 is restricted between the reset button 130 and the middle body 190.

The movable component mainly disposed under the reset component comprises a movable assembly 430 and a latching plate 540. The movable assembly 430 has a left sustaining portion 431 and a right sustaining portion 432 (shown in FIG. 14) extending under the movable ends of the movable contact strips 330, 340, respectively. Both the left sustaining portion 431 and the right sustaining portion 432 are in a shape which allows the inner sub-strips 332, 342 and the outer sub-strips 334, 344 to rest on different horizontal planes to maintain good contacts both between the first movable contacts and load contacts (390 and 280, 400 and 270) and between second movable contacts and fixed contacts (392 and 290, 402 and 260) when the circuit interrupter 100 is in a reset condition. As shown in FIGS. 6-11, each of the left sustaining portion 431 and the right sustaining portion 432 of the movable assembly 430 has an upper surface 431-2, 432-2 and a lower surface 431-1, 432-1 so that the inner sub-strips 332, 342 and the outer sub-strips 334, 344 can rest on different horizontal planes. People with ordinary skill in the art would appreciate other shapes to achieve the same result.

In one embodiment (shown in FIG. 6A), the sustaining portions 431, 432 have the upper surfaces 431-2, 432-2 under the inner sub-strips 332, 342 and have the lower surfaces 431-1, 432-1 under the outer sub-strips 334, 344. The inner sub-strips 332, 342 are respectively supported by the upper surfaces 431-2, 432-2 of the sustaining portions. As a result, when the movable assembly 430 moves up, the inner sub-strips 332, 342 are brought up to a position so that the first movable contacts 390, 400 maintain a good contact with corresponding load contacts 280, 270. As stated above, both the outer sub-strips 334, 344 and the inner sub-strips 332, 342 are respectively a portion of the movable contact strips 330, 340. Thus, at the same time the outer sub-strips 334, 344 are also brought up by the movement of the movable assembly 430 to a position so that the second movable contacts 392, 402 maintain a good contact with corresponding fixed contacts 290, 260. Due to manufacturing factors, the outer sub-strips 334, 344 may not be on precisely the same horizontal plane as the inner sub-strips 332, 342. In order to maintain good contacts between the second movable contacts 392, 402 and the corresponding fixed contacts 290, 260, the lower surfaces 431-1, 432-1 of the sustaining portions provide the outer sub-strips 334, 344 a flexibility to rest on different horizontal planes which can be above or on the lower surfaces 431-1, 432-1. The height difference between the upper surface 431-2, 432-2 and the lower surface 431-1, 432-1 can range from 0.01 mm to 5 mm. In another embodiment (shown in FIG. 6B), the sustaining portions 431, 432 have the lower surfaces 431-1, 432-1 under the inner sub-strips 332, 342 and have the upper surfaces 431-2, 432-2 under the outer sub-strips 334, 344.

Figure 14:
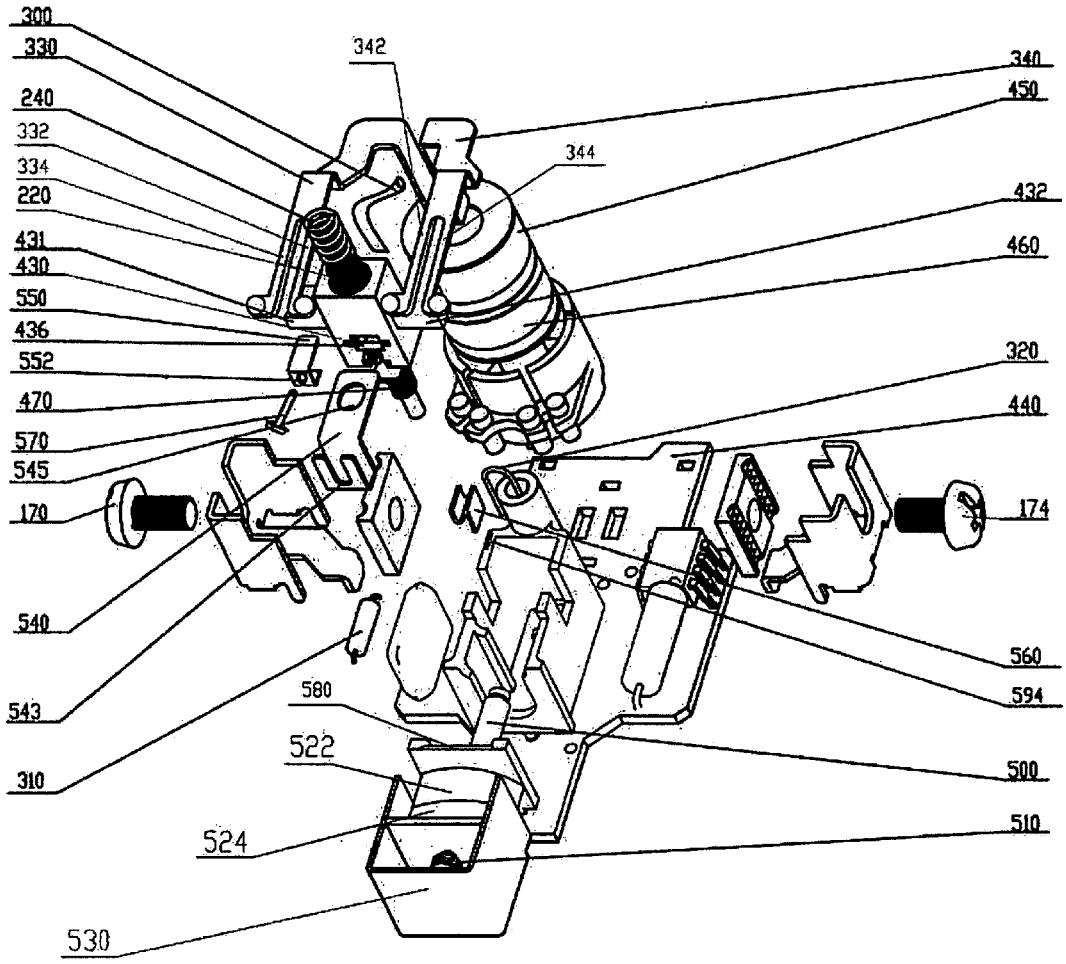
FIG. 14 is an exploded view of the circuit interrupter in FIG. 12.

As shown in FIG. 14, the movable assembly 430 has a cavity, a middle spring 220, a pair of latching slots 436, a reverse shaft portion 480, and a reverse spring 470. The cavity with an opening on the top accommodates a lower portion of the reset shaft 180. An upper portion of the cavity is wider so that the middle spring 220 can partially sit in and surround the lower portion of the reset shaft 180. As a result, the middle spring 220 is restricted between a lower surface of the middle body 190 and the inner wall of the cavity. People in the art understand that under certain circumstances the middle spring 220 is not necessary to achieve the intended function. The reverse shaft portion 480 can be made in one piece with the body of movable assembly 430 and be made with the same material. People with ordinary skill in the art understand that the reverse shaft portion 480 can be made in a separate piece from the body of movable assembly 430 with the same or different material. The separate reverse shaft portion 480 can be fastened to a bottom plate portion 490 of the movable assembly 430. One end of the reverse shaft portion 480 penetrates into a circuit board 440. The reverse spring 470 surrounds the reverse shaft portion 480 and is restricted between the bottom plate portion 490 of the movable assembly 430 and the circuit board 440. The pair of latching slots 436 are disposed on both side walls of the movable assembly 430 allowing the latching plate 540 to extend through the movable assembly 430.

The latching plate 540 has a latching portion with a latching hole 545 and a clasp portion with a clasp opening 543. The latching portion extends through the movable assembly 430 via the latching slots 436. The latching hole 545 is disposed on the latching portion so that the reset shaft 180 can penetrate the latching hole 545 to latch with the latching plate 540 when the GFCI receptacle 100 is in a reset condition. The clasp opening 543 is arranged to allow the latching plate 540 to be able to move up and down while remaining to be clasped with the trip component. In this embodiment, the clasp portion has a U-shaped opening 543.

Figure 12:
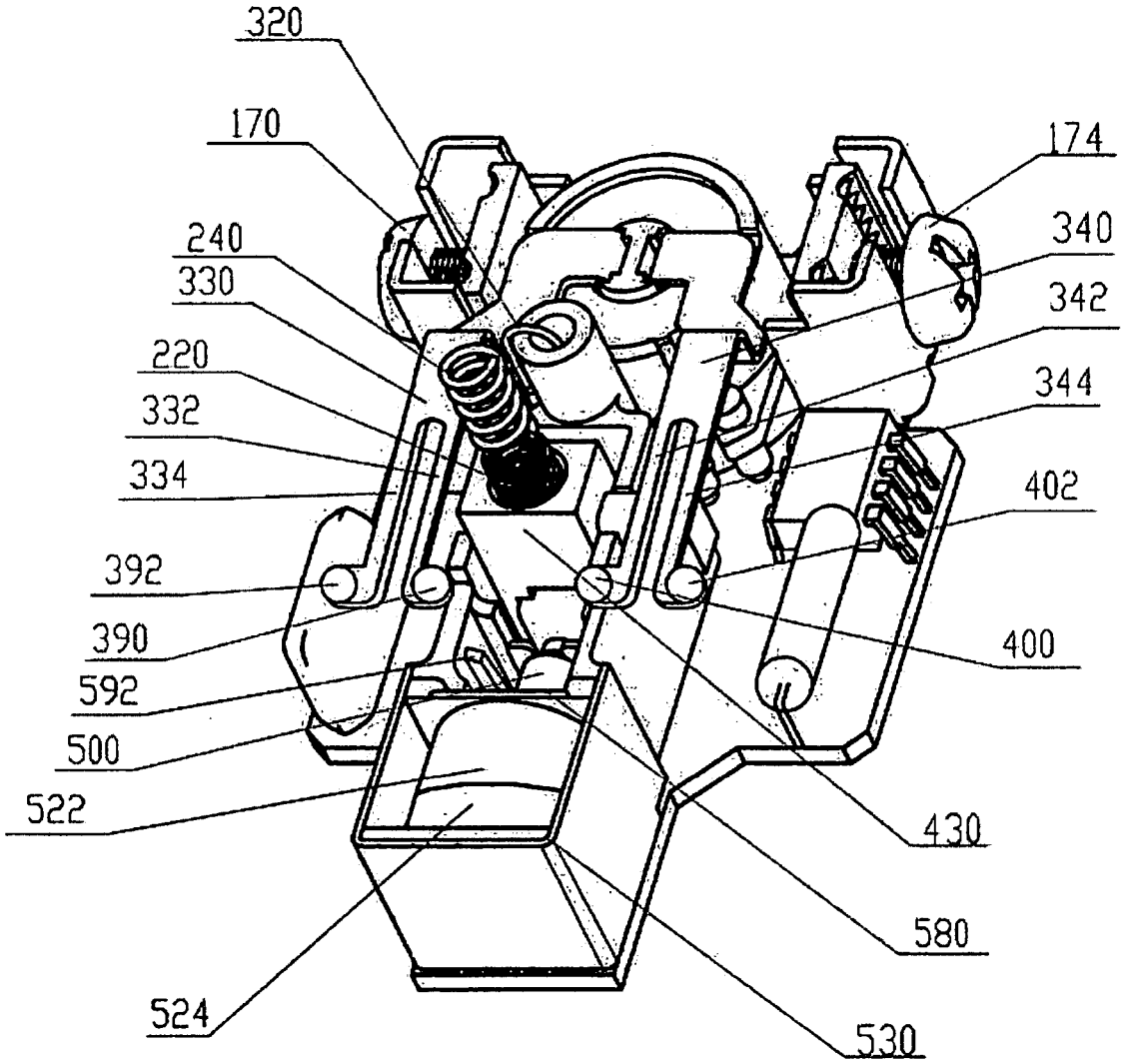
FIG. 12 is a perspective view of the circuit interrupter in FIG. 3 with a rear portion removed.

The trip component comprises a trip shaft 500, a trip spring 510, an electromagnetic unit, and a control circuit. The electromagnetic unit contains a trip coil 520, a shield plate 580 disposed right before the trip coil 520, and a metal shield 530. The metal shield 530 covers at least two sides of the trip coil 420 and is abutted against one side of the rear portion 150. The trip shaft 500 has a first end clasped with the U-shaped clasp opening 543 in the clasp portion of the latching plate 540 and a second end disposed inside the trip coil 520. The trip coil 520 may comprise a primary trip coil 522 and an auxiliary trip coil 524. When the primary trip coil 522 loses its function due to control circuit damage, the auxiliary trip coil 524 can be activated to move the latching plate 540 which in turn releases the reset shaft 180 to disconnect the electrical paths. A portion of the trip spring 510 surrounds a narrower portion of the trip shaft 500 at its second end. The remaining portion of the trip spring 510 forms a space for the movement of the trip shaft 500. The trip spring 510 is restricted between the shield metal 530 and a constricting surface of the trip shaft 500. The trip spring 510 can be in a conical shape or in a cylinder shape. When activated by the control circuit, the electromagnetic unit pulls the trip shaft 500 which in turn pulls the latching plate 540 so that the reset shaft 180 can be latched with or released from the latching hole 545. To control the moving distance of the trip shaft 500, the movable assembly accommodation base 590 may have a blocking portion 592 (as shown in FIG. 12) extended before or after the latching plate 540 to control the moving distance of the trip shaft 500. The blocking portion 592 can be disposed on both sides of the trip shaft 500.

Figure 13:
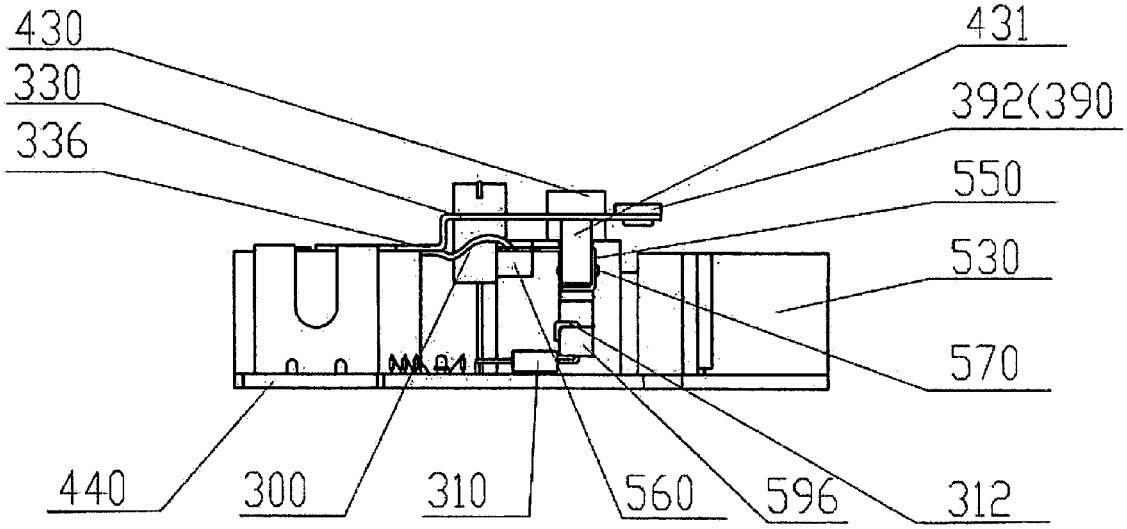
FIG. 13 is left-to-right side view of the circuit interrupter in FIG. 12.

The control circuit activates the electromagnetic unit upon detecting a ground fault condition, a test request, and a reset request. The control circuit has a reset resistor 310, a reset contact 312, a test resistor 320, a sensing coil 460, and a neutral coil 450. The sensing coil 460 and the neutral coil 450 detect a fault condition. The reset contact 312 is disposed to contact with the protruding contact 550 to activate the reset operation. In one embodiment, the reset contact 312 is a portion of the reset resistor 310. As shown in FIG. 13, the reset contact 312 is disposed on the top of a fixing stand 596 which is a portion of the movable assembly accommodation base 590. In another embodiment, the reset contact 312 is a conductive strip disposed to be electrically coupled to the reset resistor 310. When the reset button 130 is pressed down to cause the protruding contact 550 to contact with the reset contact 312, the left movable contact strip 330 is electrically coupled to the reset resistor 310 so that a close circuit is formed and a diverted current is generated. Accordingly, the control circuit activates the electromagnetic unit to perform the reset operation. Similarly, the control circuit activates the electromagnetic unit when a test strip 230 is pressed down to contact a test resistor 320 and to form a close circuit.

Figure 5:
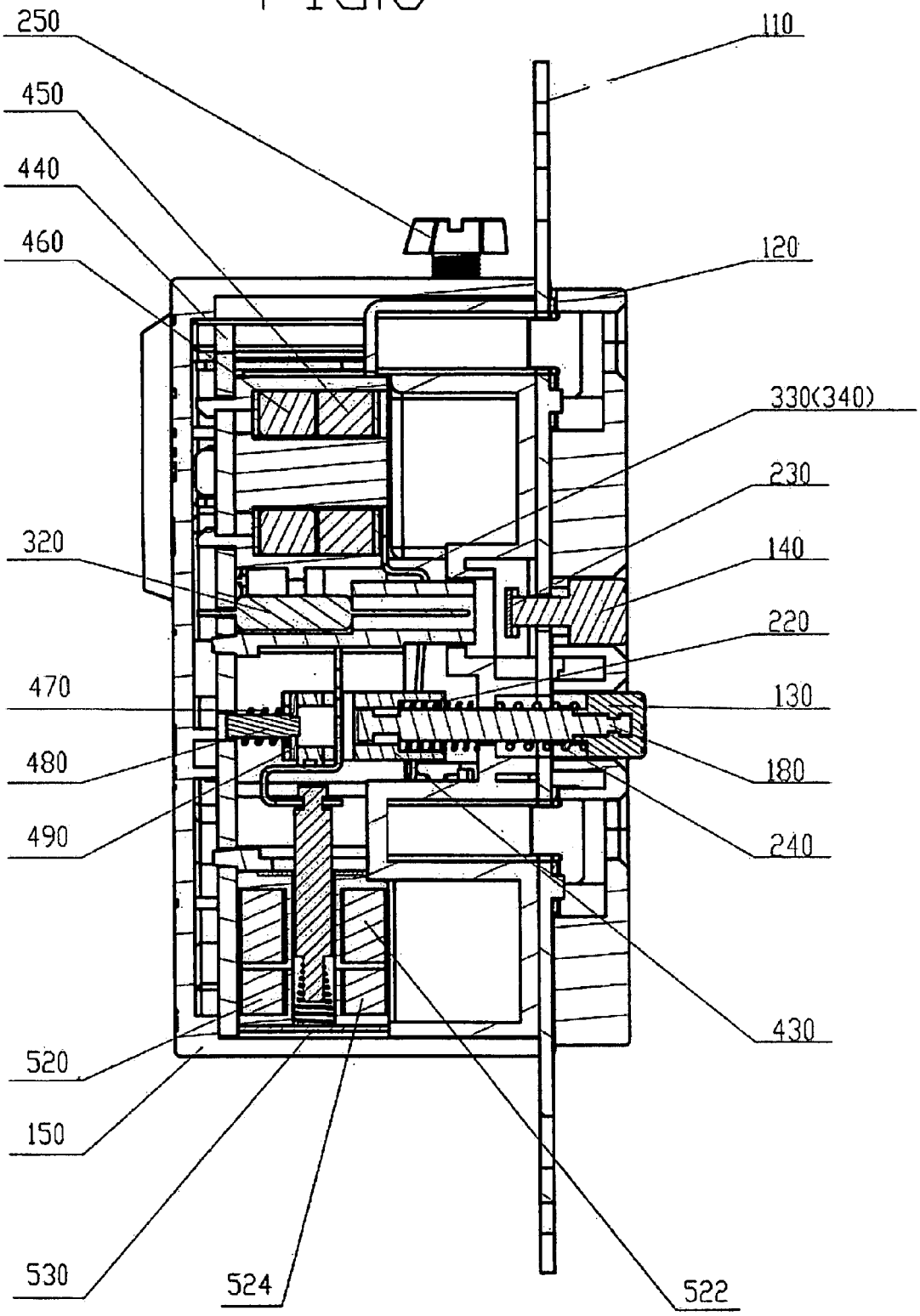
FIG. 5 illustrates a cross-sectional view of the circuit interrupter in FIG. 1 along the AA line in a trip condition.

The circuit interrupter 100 is originally stable at a trip condition as shown in FIGS. 5 and 6. The movable component is at a first position where movable ends of the movable contact strips 330, 340 stay on the sustaining portions 431, 432 of the movable assembly 430 and are separated from the fixed contact strips 200, 210 and load contact strips 350, 360. The left movable contact strip 330 is not electrically coupled to the reset contact 312. The movable assembly 430 is at a stabilized position due to the balance among the reset spring 240, the middle spring 220, and the reverse spring 470.

After the circuit interrupter 100 is correctly wired, the reset button 130 is pressed to establish the electrical continuity in the conductive paths. When the reset button 130 is pressed, the reset shaft 180 moves down to push onto a surface of the latching plate 540. The latching plate 540 brings the movable assembly 430 to move down. The movable ends of the movable contact strips 330, 340 move down due to their own elasticity. The left movable contact strip 330 is electrically coupled to the reset resistor 310 through the protruding contact 550 and the reset contact 312 to form a close circuit and to generate a reset request. In one embodiment, the protruding contact 550 is electrically coupled to the left movable contact strip 330 through a connecting strip 300. The protruding contact 550 is attached to the left sustaining portion 431 of the movable assembly 430 by inserting a rivet 570 through a fastening hole 552 on the protruding contact 550 and a corresponding hole 437 on the left sustaining portion 431 of a movable assembly 430. People with ordinary skills in the art will appreciate other ways to attach the protruding contact 550 to the left sustaining portion 431 of the movable assembly 430. The connecting strip 300 connects the protruding contact 550 and a connecting portion 336 of the left movable contact strip 330. The connecting strip 300 may comprise copper. Materials such as a soft copper cord or a copper strip can be used. In another embodiment, the left movable contact strip 330 contains a protruding contact 550. The movable assembly 430 is at a transient second position where the movable ends of the movable contact strips 330, 340 are separated from the fixed contact strips 200, 210 and load contact strips 350, 360. At the same time, the left movable contact strip 330 is electrically coupled to the reset contact 312, either directly or indirectly, to activate a reset operation.

Because of the closed circuit resulting from the electric connection, the control circuit activates the electromagnetic unit to pull the trip shaft 500. The trip shaft 500 then pulls the latching plate 540 by overcoming friction force between the reset shaft 180 and the latching plate 540 as well as the elastic force from the pressed trip spring 510. When the latching hole 545 moves to a position right under the reset shaft 180, a head portion of the reset shaft 180 penetrates the latching hole 545. At the moment, because the pressure given onto the latching plate 540 by the reset shaft 180 vanishes, the pressed reverse spring 470 bounces back to move the movable assembly 430 up. The left sustaining portion 431 of the movable assembly 430 pushes the left movable contact strip 330 up. As a result, the protruding contact 550 separates from the reset contact 312. Because of the open circuit resulting from the separation, the control circuit inactivates the electromagnetic unit to cease the pulling force. The pressed trip spring 510 then bounces back to push the latching plate 540 and causes a neck portion of the reset shaft 180 to latch with the latching hole 545.

When the reset button is released, the pressed reset spring 240 bounces back to move up the reset shaft 180. The reset shaft 180 brings up the movable assembly 430 through the latching plate 540 that latches with the reset shaft 180. Overcoming the elastic forces from the pressed middle spring 220 and the movable contact strips 330, 340, the movable assembly 430 with the sustaining portions 431, 432 pushes the movable ends of the movable contact strips 330, 340 to a position where the first movable contacts 390, 400 maintain a good contact with the respective load contacts 280, 270 and the second movable contacts 392, 402 maintain a good contact with the respective fixed contacts 290, 260. The movable assembly 430 is then at a third position when the circuit interrupter 100 is at a reset condition.

The circuit interrupter 100 may include a resistive strip 560 disposed in a way to cause a transient blocking effect when the reset button 130 is pressed down to initiate a reset operation. In one embodiment, the resistive strip 560 is attached to a movable assembly accommodation base 590 and extends under the left sustaining portion 431 of movable assembly 430 by inserting a portion of the resistive strip 560 into an insertion slot 594 on the base 590. When the reset button 130 is pressed, the reset shaft 180 moves down to push onto the surface of the latching plate 540. The latching plate 540 brings the movable assembly 430 to move down. At this moment, the resistive strip temporarily blocks the movement of the movable assembly 430. After the reset button 130 is pressed with more force, the movable assembly 430 overcomes the elastic force of the resistive strip 560 and continues to move down. In one embodiment, the resistive strip 560 comprises stainless steel and is in an upwardly curved shape. People in the art understand that other material with good elasticity can be used and the resistive strip 560 can be made in other shapes. In addition, to increase the resistivity, a spring may be disposed under the resistive strip 560 and be supported by a stand extended from the movable assembly accommodation base 590. Although the resistive strip 560 may comprise metal, it does not form any part of the control circuit or conductive paths. The resistive strip 560 can prevent children from accidentally pressing down the reset button 130 and activating the reset operation.

In addition, people in the art will appreciate that other elastic materials such as elastic tubes can be used to replace the reset spring 240, the middle spring 220, the reverse spring 470, and the trip spring 510. In this embodiment, the load contacts 280, 270 and the fixed contacts 290, 260 have a flat contact surface and the first movable contacts 390, 400 and the second movable contacts 392, 402 have a protruding contact surface, such as a hemispherical shape. In this embodiment, all contacts comprise copper alloy and the contacting surfaces of all contacts are coated with silver alloy. People in the art understand that the load contacts 280, 270, the fixed contacts 290, 260, the first movable contacts 390, 400, and the second movable contacts 392, 402 can be made in other shapes and by other materials. In this embodiment, when activated by the control circuit, the electromagnetic unit pulls the trip shaft 500 so that the reset shaft 180 can be latched with or released from the latching hole 545. However, people in the art appreciate that when activated by the control circuit, the electromagnetic unit can also push the trip shaft 500 to achieve the same results.

If the circuit interrupter 100 has a reverse wiring, the control circuit is not supplied with electricity to activate the electromagnetic unit when the protruding contact 550 contacts the reset contact 312 so that the reset function is disabled. When the circuit interrupter 100 is in a trip condition, the control circuit is connected to the line (input) side of the circuit interrupter 100 only and is not connected to the load (output) side. As a result, if the line wires are connected to the load (output) side of the circuit interrupter 100, no power supply is provided to the control circuit and the reset function is disabled. In detail, because the latching plate 540 is not moved to allow the reset shaft 180 to penetrate the latching hole 545, the reset shaft 180 does not latch with the latching plate 540. Thus, when the reset button 130 is released, due to the elastic force from the pressed reset spring 240, the reset shaft 180 moves up alone without bringing up the movable assembly 430. When the latching plate 540 is not pressured by the reset shaft 180, the pressed reverse spring 470 bounces back to move up the movable assembly 430. After the elastic forces from the reverse spring 470, the middle spring 220, and the movable contact strips 330, 340 reach a balance, the movable assembly 430 comes back to the first position where movable ends of the movable contact strips 330, 340 separate from the fixed contact strips 200, 210 and the load contact strips 350, 360. The circuit interrupter 100 remains in the trip condition. Failure to reset the circuit interrupter 100 provides a warning of the reverse wiring. When an installer cannot reset the circuit interrupter 100, he realizes that it is wrongly wired and is able to correct the wiring instantly.

In addition, to provide a better protection, if there is a reverse wiring which means line wires are connected to the load (output) ends, the circuit interrupter 100 cannot function as a receptacle at all and no electricity is provided to any plug-in electronic apparatus. It prevents people from using the receptacle without the protection of ground fault current interruption. Besides, an installer or a user can easily find out the reverse wiring and correct it. Otherwise, people cannot use the circuit interrupter 100 at all. As described above, because the control circuit is not provided with electricity to perform a reset operation, the circuit interrupter 100 remains in a trip condition even after the reset button 130 is pressed. There is no conductive path between the load end connections 172, 176 and the binding terminals of user accessible load connections 122, 124 because the load contact strips 350, 360 are separated from the movable contact strips 330, 340.

Figure 16:
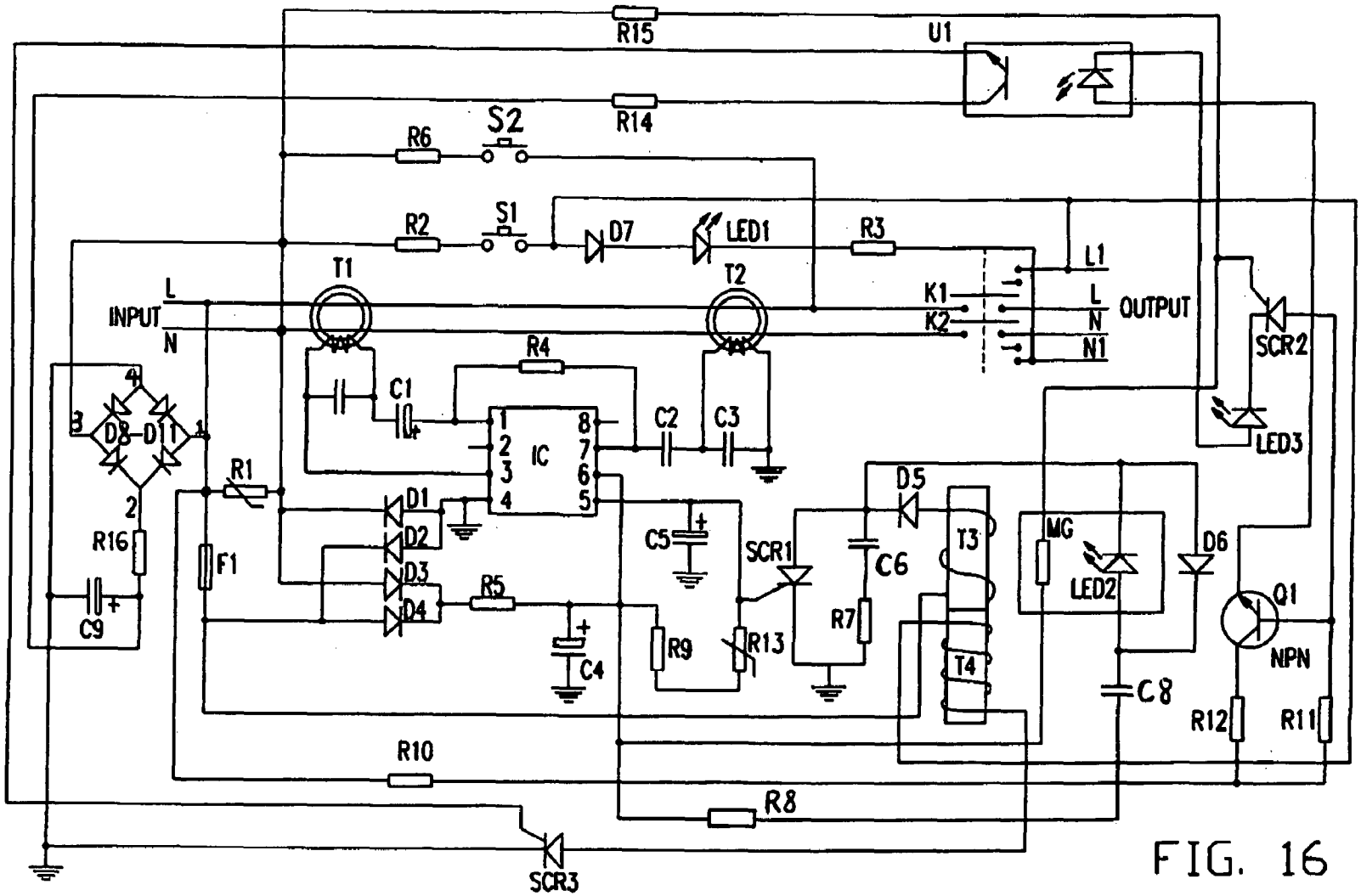
FIG. 16 is a schematic diagram of a control circuit in the circuit interrupter in FIG. 1.

The circuit interrupter 100 may further contain a reverse-wiring detection circuit to indicate a reverse-wiring condition and to warn an installer by lights or sounds. The reverse-wiring detection circuit may include a diode, a resistor, and a signal-generating device. The signal-generating device can be a light emitting diode (LED) or an alarm. The LED can be disposed on any location of the face portion 120 as long as lights from the LED can be seen from the top of the receptacle 100. Skilled artisans know there are several ways to apply the LED for signaling a reverse-wiring. Examples of using one LED include: a red LED is turned on to warm an installer and a user when there is a reverse wiring; a green LED is turned on to assure that the GFCI receptacle 100 works in a good condition when there is a correct wiring. Two or more LEDs may be used in the circuit interrupter 100. For example, a red LED is turned on to signal a reverse wiring and a green (or blue or yellow) LED is turned on to signal a correct wiring. As shown in FIG. 16, an embodiment has a reverse-wiring detection circuit that includes a diode D7, a resistor R3 and an LED component LED1. Only when the circuit interrupter 100 is installed correctly and the conduction paths are established after pressing the reset button 130 to appropriately provide electric power, the LED1 turns on. Thus, if the LED1 is not on, an installer and a user are warned and reminded to check the wiring.

A test mechanism is installed to test whether the electrical continuity can be broken by simulating a ground fault condition. The test component comprises the test button 140 and the test strip 230. One end of the test strip 230 is electrically coupled to the left fixed contact strip 210 and the other end hangs under the test button 140. When the electrical continuity is established and the test button 140 is pressed, the test button 140 pushes the test strip 230 down to contact the test resistor 320 of the control circuit. As a result, the control circuit activates the electromagnetic unit to pull the trip shaft 500. Overcoming the elastic force from the trip spring 510, the trip shaft 500 pulls the latching plate 540 to release the reset shaft 180 from the latching hole 545. After releasing from the reset shaft 180, the movable assembly 430 and the latching plate 540 move down due to the elastic forces from the pressed middle spring 220 and the movable contact strips 330, 340. The movable ends of the movable contact strips 330, 340 move down and separate from both the fixed contact strips 200, 210 and the load contact strips 350, 360. When the downward elastic force balances the upward elastic force from the pressed reverse spring 470, the movable assembly 430 is stabilized at the first position where the movable ends of the movable contact strips 330, 340 separate from the fixed contact strips 200, 210 and the load contact strips 350, 360. The protruding contact 550 separates from the reset contact 312 so that the left movable contact strip 330 is not electrically coupled to the reset resistor 310. As a result, the electrical continuity is broken and the circuit interrupter 100 is in a trip condition.

When the control circuit detects a ground fault condition, it activates the electromagnetic unit to pull the trip shaft 500. The remaining process is the same as that of the test operation.

FIG. 16 shows an exemplary embodiment of the control circuit and its relationship with other components of the circuit interrupter 100. Input L is the line phase connection and Input N is the line neutral connection. Output L is the load phase connection and Output N is the load neutral connection. Output L1 is the user load phase connection and Output N1 is the user load neutral connection. The phase and neutral conductive paths of the input (line) side pass through both a sensing transformer 460 (T1) and a neutral transformer 450 (T2) that are used to detect the imbalance of the currents between the phase and the neutral conductive path.

A resistor R4 connects between the terminal 1 and terminal 7 of an RV 4145 IC. The magnitude of the resistor R4 determines the threshold value for the tripping action of the circuit interrupter 100 to occur. In other words, if the control circuit detects a current imbalance greater than the threshold value, it activates the electromagnetic unit to break the electrical continuity. In this embodiment, the threshold value is about 4-6 mA.

In the absence of a ground fault condition, the currents following through the phase and neutral conductive paths are equal and opposite. No net flux is generated in the core of the sensing transformer 460 (T1). In the event that the current is diverted because of another electrical connection between the phase conductor of the load side and the ground, the currents flowing through the phase and neutral conductors are unequal and a net flux is generated. When the flux reaches the threshold value determined by the resistor R4, the terminal 5 of the IC generates a signal to activate the primary trip coil 522 (T3). As a result, the trip shaft 500 pulls the latching plate 540 so that the reset shaft 180 releases from the latching plate 540, and the electrical continuity both between the first movable contacts 390, 400 and the load contacts 280, 270 and between the second movable contacts 392, 402 and the fixed contacts 290, 260 is interrupted.

When the circuit interrupter 100 is in a trip condition and the reset button 130 (S2) is pressed, a diverted current flows from Input N through the reset resistor 310 (R6), the reset contact 312, the protruding contact 550, the connecting strip 300, and the left movable contact strip 330 to the Input L. An imbalance of the currents flowing through the phase and neutral conductive paths is generated so that terminal 5 of the IC sends a signal to activate the primary trip coil 522 (T3) of the electromagnetic unit. As mentioned above, because the trip shaft 500 pulls the latching plate 540 to latch the reset shaft 180 with the latching hole 545, the movable assembly 430 moves up to the third position where the first movable contacts 390, 400 maintain a good contact with the respective load contacts 280, 270 and the second movable contacts 392, 402 maintain a good contact with the respective fixed contacts 290, 260. The electrical continuity is established.

When the circuit interrupter 100 is in a reset condition and the test button 140 (S1) is pressed, a diverted current flows from Input N through the test resistor 320 (R2), the test strip 230, and the left fixed contact strip 210 to the Output L1. An imbalance of the currents flowing through the phase and neutral conductive paths is generated so that terminal 5 of the IC sends a signal to activate the primary trip coil 522 (T3) of the electromagnetic unit. As mentioned above, because the trip shaft 500 pulls the latching plate 540 to release the reset shaft 180 from the latching hole 545, the movable assembly 430 moves down to the first position where the first movable contacts 390, 400 separate from the respective load contacts 280, 270 and the second movable contacts 392, 402 separate from the fixed contacts 290, 260. The electrical continuity is broken.

The control circuit also has the function of end-of-life protection. To protect users, the circuit interrupter 100 can indicate by visual means that the circuit interrupter reaches the end of its life. In addition, the circuit interrupter 100 can be tripped to disconnect a conduction path when the circuit interrupter 100 reaches the end of its life. The contents of the patent application Ser. No. 11/449,991 filed on Jun. 9, 2006 by Ping Wang is incorporated in its entirety.

When the primary trip coil 522 (T3) does not function to break the conduction paths because some related electrical component is out of order, the auxiliary trip coil 524 (T4) can be activated to move the trip shaft 500 which in turn pulls the latching plate 540. In other words, when some electrical component related to the primary trip coil 522 (T3) is out of order, an end life sensing circuit sends a signal to an end life indicating circuit which in turn sends a signal to an auxiliary trip coil circuit to activate the auxiliary trip coil 524 (T4). As a result, the reset shaft 180 releases from the latching plate 540, and the electrical continuity both between the first movable contacts 390, 400 and the load contacts 280, 270 and between the second movable contacts 392, 402 and the fixed contacts 290, 260 is interrupted. The circuit interrupter 100 reaches the end of its life and can no longer be reset.

The end life sensing circuit includes a light emitting diode LED2, a light sensitive resistor MG, a diode D6, a capacitor C8 and a resistor R8. The resistance of the light sensitive resistor MG is controlled by the light emitted from the light emitting diode LED2. In one embodiment, the capacitor C8 has a capacitance at about 0.001-10 μF. The resistor R8 has a resistance at about 10-60 k Ohms.

In the end life sensing circuit, the anode of the light emitting diode LED2 is connected to the cathode of the diode D6 and the first end of the capacitor C8. The second end of the capacitor C8 is connected to the first end of the resistor R8. The second end of the resistor R8 is connected to a resistor R5 and a capacitor C4. The cathode of the light emitting diode LED2 is connected to the anode of the diode D6 and node A. The first end of the light sensitive resistor MG is connected to the resistor R5. The second end of the light sensitive resistor MG is connected to the end life indicating circuit.

The end life indicating circuit includes a light emitting diode LED3 to function as a visual indicator, a transistor Q1, a resistor R12, a resistor R11, a resistor R10 and a silicon controlled rectifier SCR2. In one embodiment, the resistor R12 has a resistance at about 1-20 k Ohms; the resistor R11 has a resistance at about 10-60 k Ohms; and the resistor R10 has a resistance at about 50-600 k Ohms. The silicon controlled rectifier SCR2 has a trigger current at about 10-200 μA. The transistor Q1 is an NPN transistor.

In the end life indicating circuit, the first ends of the resistor R12 and the resistor R11 are connected to a line side of the power supply Input L through the resistor R10. The second end of the resistor R12 is connected to the collector of the NPN transistor Q1. The second end of the resistor R11 is connected to the base of the NPN transistor Q1 and the anode of the second silicon controlled rectifier SCR2. The emitter of the NPN transistor Q1 is connected to the anode of the light emitting diode in an optocoupler U1 of the auxiliary trip coil circuit. The cathode of the light emitting diode in the optocoupler U1 is connected to the anode of the light emitting diode LED3. The cathode of the light emitting diode LED3 is connected to the cathode of the silicon controlled rectifier SCR2. The gate of the silicon controlled rectifier SCR2 is connected to the light sensitive resistor MG and to the Input N through a resistor R15.

The auxiliary trip coil circuit includes the bridge rectifier D8-D11, a resistor R16, a capacitor C9, a resistor R14, an optocoupler U1 having a light emitting diode and a phototransistor, a silicon controlled rectifier SCR2. The bridge rectifier D8-D11 is coupled to the power supply Input L and Input N to receive an alternating current and to output a direct current. One output end of the bridge rectifier D8-D11 is connected to the ground and the negative end of the capacitor C9. The other output end of the bridge rectifier D8-D11 is connected to the first end of the resistor R16. The second end of the resistor R16 is connected to the positive end of the capacitor C9 and the first end of the resistor R14. The second end of the resistor R14 is connected to the collector of the phototransistor in the optocoupler U1. The emitter of the phototransistor is connected to the gate of the silicon controlled rectifier SCR3. The cathode of the silicon controlled rectifier SCR3 is connected to the ground. The anode of the silicon controlled rectifier is connected to one end of the auxiliary trip coil 524. The second end of the auxiliary trip coil 524 is connected to the Output L1.

When the circuit interrupter 100 functions properly, the light emitting diode LED2 is turned on and the light emitting diode LED3 is turned off. The light emitting diode LED2 is boosted to emit lights which shed on the light sensitive resistor MG to reduce its resistance. When the resistance of the light sensitive resistor MG is low, the direct current from the bridge rectifier D1-D4 is provided through the light sensitive resistor MG to the gate of the silicon controlled rectifier SCR2. As a result, the silicon controlled rectifier SCR2 is turned on. A current flowing through the resistor R11 and the silicon controlled rectifier SCR2 can not pass the light emitting diode LED3. Thus, the light emitting diode LED3 is turned off.

When the circuit interrupter 100 reaches the end of its life, the light emitting diode LED3 is turned on and/or the circuit interrupter 100 is tripped to warn consumers that the circuit interrupter 100 can no longer protect people from electric shock. The circuit interrupter 100 reaches the end of its life if some electrical components are broken so that the circuit interrupter 100 does not function properly to disconnect the conduction path via activating the primary trip coil 522 after detecting a predetermined condition. These components may include the silicon controlled rectifier SCR1, the bridge rectifier D1-D4, the resistor R5, the capacitor C4 and the control chip.

The auxiliary trip coil 524 is activated to disconnect the conduction paths when the primary trip coil 522 does not function because some related electrical components are broken. The broken electrical component causes the fuse F1 to be blown. As a result, the light emitting diode LED2 is turned off and no current is provided through the light sensitive resistor MG to the gate of the second silicon controlled rectifier SCR2. The silicon controlled rectifier SCR2 is turned off and the NPN transistor Q1 is turned on. A current flows through the light emitting diode in the optocoupler U1 and the light emitting diode LED3 to a virtual ground. The light emitting diode LED3 is then turned on to indicate that the circuit interrupter 100 has reached the end of its life and needs to be replaced. At the same time, the light emitting diode in the optocoupler U1 is also turned to provide a current from the phototransistor to the gate of the silicon controlled rectifier SCR3. The silicon controlled rectifier SCR3 is then turned on to activate the auxiliary trip coil 524 (T4). As a result, the trip shaft 500 pulls the latching plate 540 to release the reset shaft 180 from the latching hole 545. The movable assembly 430 moves down to the first position where the first movable contacts 390, 400 separate from the respective load contacts 280, 270 and the second movable contacts 392, 402 separate from the fixed contacts 290, 260. The electrical continuity is broken. The circuit interrupter 100 is in the trip condition and can no longer be reset. The auxiliary trip coil 524 (T4) makes the circuit interrupter 100 a safer device.

Although the invention has been described in terms of exemplary embodiments, it is not limited thereto. The described embodiment is to be considered in all respects only as illustrative and not as restrictive. The present invention may be embodied in other specific forms without departing from its essential characteristics. The scope of the invention, therefore, is indicated by the appended claims rather than by the foregoing description. All changes which come within the meaning and range of the equivalents of the claims are to be embraced within their scope.

What is claimed is:

1. A circuit interrupter comprising:

a pair of fixed contact strips, each of the fixed contact strips having a fixed contact;

a pair of load contact strips, each of the load contact strips having a load contact;

a pair of movable contact strips, each of the movable contact strips having a fixed end and a movable end, the movable end of each movable contact strip split into an inner sub-strip and an outer sub-strip, each of the movable ends having a first movable contact disposed on the inner sub-strip arranged for contacting one of the corresponding load contacts and a second movable contact disposed on the outer sub-strip arranged for contacting one of the corresponding fixed contacts;

a reset component;

a trip component comprising a reset contact; and a movable component disposed to sustain the movable ends of the movable contact strips, the movable component capable of either being latched with or released from the reset component to move between a first position where the first movable contacts are separated from the load contacts, and the second movable contacts are separated from the fixed contacts, and the movable contact strips are not electrically coupled to the reset contact, a second position where the first movable contacts are separated from the load contacts, and the second movable contacts are separated from the fixed contacts, and at least one of the movable contact strips is electrically coupled to the reset contact, and a third position where the first movable contacts make contact with the corresponding load contacts, and the second movable contacts make contact with the corresponding fixed contacts, and the movable contact strips are not electrically coupled to the reset contact;

wherein the trip component is capable of latching the reset component with the movable component for the movable component to move to the third position upon detection of a reset request and capable of releasing the reset component from the movable component for the movable component to move to the first position upon detection of a fault condition;

wherein the movable component is capable of allowing the inner sub-strips and the outer sub-strips to rest on different horizontal planes.

2. The circuit interrupter of claim 1, wherein the load contacts and the fixed contacts have a flat contact surface; and the first movable contacts and the second movable contacts have a protruding contact surface.

3. The circuit interrupter of claim 2, wherein the contact surfaces comprise silver.

4. The circuit interrupter of claim 1, further comprising:

a resistive strip disposed in a way to cause a transient blocking effect when the movable component moves from the first position to the second position.

5. The circuit interrupter of claim 1, wherein the reset component comprises a reset button, a reset shaft attached to the reset button, and a reset spring surrounding an upper portion of the reset shaft.

6. The circuit interrupter of claim 5, wherein the movable component comprises a movable assembly and a latching plate capable of being latched with the reset shaft and holding the movable assembly to move between different positions.

7. The circuit interrupter of claim 6, wherein the movable assembly comprises sustaining portions extended under the movable ends of the movable contact strips, a cavity to accommodate a lower portion of the reset shaft, at least one latching slot for the latching plate to insert, a reverse shaft, and a reverse spring surrounding the reverse shaft.

8. The circuit interrupter of claim 7, wherein the movable assembly further comprises a middle spring disposed in the cavity and surrounding the lower portion of the reset shaft.

9. The circuit interrupter of claim 7, wherein the sustaining portion has a stepping structure with an upper surface and a lower surface so that the inner sub-strip and the outer sub-strip can rest on different horizontal planes.

10. The circuit interrupter of claim 9, wherein the inner sub-strip is sustained by the upper surface of the sustaining portion.

11. The circuit interrupter of claim 10, wherein the outer sub-strip rests above the lower surface of the sustaining portion when the second movable contact contacts the corresponding fixed contact.

12. The circuit interrupter of claim 9, wherein the outer sub-strip is sustained by the upper surface of the sustaining portion.

13. The circuit interrupter of claim 12, wherein the inner sub-strip rests above the lower surface of the sustaining portion when the second movable contact contacts the corresponding fixed contact.

14. The circuit interrupter of claim 6, wherein the tripping component comprises a trip shaft capable of being clasped with the latching plate, a trip spring surrounding the trip shaft, an electromagnetic unit capable of moving the trip shaft, and a control circuit to activate the electromagnetic unit upon detecting a predetermined condition.

15. The circuit interrupter of claim 14, wherein the control circuit has an end-of-life protection function.

16. The circuit interrupter of claim 14, wherein the control circuit is capable of breaking conduction paths when the circuit interrupter reaches an end of its life.

17. The circuit interrupter of claim 14, wherein the control circuit is capable of indicating by visual means that the circuit interrupter reaches an end of its life.

18. The circuit interrupter of claim 14, wherein the electromagnetic unit comprises a trip coil which includes a primary trip coil and an auxiliary trip coil.

19. The circuit interrupter of claim 18, wherein the control circuit can activate the auxiliary trip coil to break conduction paths when the primary trip coil does not function.

20. A circuit interrupter comprising:

a pair of fixed contact strips, each of the fixed contact strips having a fixed contact;

a pair of load contact strips, each of the load contact strips having a load contact;

a pair of movable contact strips, each of the movable contact strips having a fixed end and a movable end, the movable end of each movable contact strip split into an inner sub-strip and an outer sub-strip, each of the movable ends having a first movable contact disposed on the inner sub-strip arranged for contacting one of the corresponding load contacts and a second movable contact disposed on the outer sub-strip arranged for contacting one of the corresponding fixed contacts;

a reset component comprising a reset button, a reset shaft attached to the reset button, and a first elastic tube surrounding an upper portion of the reset shaft;

a movable component comprising a movable assembly and a latching plate, the movable assembly capable of allowing the inner sub-strips and the outer sub-strips to rest on different horizontal planes, the latching plate capable of being latched with the reset shaft and holding the movable assembly to move between different positions;

a trip component comprising a trip shaft capable of being clasped with the latching plate, a second elastic tube, an electromagnetic unit capable of moving the trip shaft, and a control circuit to activate the electromagnetic unit upon detecting a predetermined condition.

21. The circuit interrupter of claim 20, wherein the movable assembly comprises sustaining portions extended under the movable ends of the movable contact strips, a cavity to accommodate a lower portion of the reset shaft, at least one latching slot for the latching plate to insert, a reverse shaft portion, and a third elastic tube surrounding the reverse shaft portion.

22. The circuit interrupter of claim 21, wherein

The movable assembly further comprises a fourth elastic tube disposed in the cavity and surrounding the lower portion of the reset shaft.

23. The circuit interrupter of claim 21, wherein the sustaining portion has a stepping structure with an upper surface and a lower surface so that the inner sub-strip and the outer sub-strip can rest on different horizontal planes.

24. The circuit interrupter of claim 23, wherein the inner sub-strip is sustained by the upper surface of the sustaining portion.

25. The circuit interrupter of claim 24, wherein the outer sub-strip rests above the lower surface of the sustaining portion when the second movable contact contacts the corresponding fixed contact.

26. The circuit interrupter of claim 23, wherein the outer sub-strip is sustained by the upper surface of the sustaining portion.

27. The circuit interrupter of claim 26, wherein the inner sub-strip rests above the lower surface of the sustaining portion when the second movable contact contacts the corresponding fixed contact.

28. The circuit interrupter of claim 21, wherein the latching plate comprises a latching portion and a clasp portion, the latching portion extending through the latching slot into the movable assembly and having a latching hole for the reset shaft to penetrate, the clasp portion outside the movable assembly having an opening for clasping.

29. The circuit interrupter of claim 28, wherein the clasping portion of the latching plate has a U-shape opening that is capable of moving up and down between different positions while the trip shaft remains clasped with the opening of the latching plate.

30. The circuit interrupter of claim 20, wherein the control circuit has an end-of-life protection function.

31. The circuit interrupter of claim 20, wherein the control circuit is capable of breaking conduction paths when the circuit interrupter reaches an end of its life.

32. The circuit interrupter of claim 20, wherein the control circuit is capable of indicating by visual means that the circuit interrupter reaches an end of its life.

33. The circuit interrupter of claim 20, wherein the electromagnetic unit comprises a trip coil which includes a primary trip coil and an auxiliary trip coil.

34. The circuit interrupter of claim 33, wherein the control circuit can activate the auxiliary trip coil to break conduction paths when the primary trip coil does not function.

35. The circuit interrupter of claim 20, wherein the electromagnetic unit further comprises a trip coil, a shield plate, and a metal shield;

the trip shaft is partially disposed inside the trip coil; and the electromagnetic unit, when activated, moves the trip shaft and compresses the second elastic tube so that the reset shaft can latch with or release from the latching plate.

36. The circuit interrupter of claim 20, further comprising:

a movable assembly accommodation base, a blocking portion of the movable assembly accommodation base extending before or after the latching plate to control a moving distance of the trip shaft.

37. The circuit interrupter of claim 22, wherein the first elastic tube is a reset spring, the second elastic tube is a trip spring, the third elastic tube is a reverse spring, and the fourth elastic tube is a middle spring.

38. The circuit interrupter of claim 37, wherein the reset spring has a larger elastic force than that of the middle spring.

39. The circuit interrupter of claim 22, further comprising:

a middle body disposed between the reset component and the movable component, the middle structure containing an opening through which the reset shaft penetrates;

a circuit board disposed under the reverse shaft portion, the circuit board containing an opening through which the reverse shaft portion can penetrate.

40. The circuit interrupter of claim 39, wherein the reset spring is restricted between the reset button and an upper surface of the middle body, the middle spring is restricted between the lower surface of the middle body and a inner wall of the cavity of the movable assembly, the reverse spring is restricted between a lower surface of a bottom plate portion of the movable assembly and an upper surface of the circuit board; the trip spring is restricted between a constricting surface of the trip shaft and the metal shield.

41. The circuit interrupter of claim 20, further comprising:

a test component comprising a test button and a test strip, the test strip having one end hung under the test button and the other end electrically connected to the fixed contact strip.

42. The circuit interrupter of claim 20, further comprising:

a reverse-wiring detection circuit comprising a signal-generating device to detect and signal a reverse wiring.

43. The circuit interrupter of claim 42, wherein the signal-generating device comprises at least one light emitting diode.

* * * * *